US008256921B2

(12) United States Patent
Crookham et al.

(10) Patent No.: US 8,256,921 B2
(45) Date of Patent: Sep. 4, 2012

(54) LIGHTING SYSTEM WITH COMBINED DIRECTLY VIEWABLE LUMINOUS OR TRANSMISSIVE SURFACE AND CONTROLLED AREA ILLUMINATION

(75) Inventors: Joe P. Crookham, Oskaloosa, IA (US); Thomas A. Stone, University Park, IA (US); James J. Berns, Muscatine, IA (US)

(73) Assignee: Musco Corporation, Oskaloosa, IA (US)

( * ) Notice: Subject to any disclaimer, the term of this patent is extended or adjusted under 35 U.S.C. 154(b) by 489 days.

(21) Appl. No.: 12/466,640

(22) Filed: May 15, 2009

(65) Prior Publication Data

US 2009/0284966 A1 Nov. 19, 2009

Related U.S. Application Data

(60) Provisional application No. 61/053,967, filed on May 16, 2008, provisional application No. 61/092,509, filed on Aug. 28, 2008.

(51) Int. Cl.
*F21V 13/00* (2006.01)

(52) U.S. Cl. ..... 362/242; 362/33; 362/248; 362/249.02; 362/249.06; 362/431

(58) Field of Classification Search ..... 362/33, 362/235, 242, 249.02, 249.03, 249.06, 248, 362/249.07, 431
See application file for complete search history.

(56) References Cited

U.S. PATENT DOCUMENTS 6,398,384 B2 * 6/2002 Siminovitch et al. ..... 362/225
7,093,961 B2 8/2006 Bentley et al.
7,300,327 B2 11/2007 Bolta et al.
2003/0210555 A1 11/2003 Cicero et al.
2005/0068765 A1 3/2005 Ertze Encinas et al.
2006/0291218 A1 12/2006 Pazula
2010/0002432 A1 1/2010 Romano

OTHER PUBLICATIONS

"IESNA Lighting Education—Fundamental Level", Illuminating Engineering Society of North America, 3 pages.

(Continued)

*Primary Examiner* — Stephen F Husar
(74) *Attorney, Agent, or Firm* — McKee, Voorhees & Sease, P.L.C.

(57) ABSTRACT

An apparatus, system and method for lighting an area, for example, an outdoors pedestrian area or building facade or an auto traffic area, or an indoor large area, which provides indicator/guide light, reference light for structures, and task lighting for a target area. The method uses first lighting sources that are directly viewable by observers and which can be historical, architectural, or aesthetically selected sources, but which produce a relatively low level of light or luminance insufficient to effectively light the area but sufficient to act as an indicator or guide, as well as to provide reference illumination on buildings or structures. Second lighting sources are configured to produce directional light to light the area but hide the light sources from most conventional observer viewing angles and may be enclosed within the general outlines of the globe or transmissive surface area of the fixture. Additionally, the fixture may appear to the average observer that the two sources are one historic or architectural source. Use of low-level directly viewable sources allows lower levels of light from the second sources to effectively light the area. This produces benefits regarding light pollution, such as reducing sky glow, glare, and spill light, as well as reducing energy usage.

49 Claims, 20 Drawing Sheets

OTHER PUBLICATIONS

"CEI Technical Report—Glare Evaluation System for Use within Outdoor Sports and Area Lighting", Commission Internationale De L'Eclairage International Commission on Illumination Internationale Beleuchtungskommission, 15 pages.

"Light Trespass: Research, Results and Recommendations", Prepared by the Obtrusive Light Subcommittee of the IESNA Roadway Lighting Committee, IES, 15 pages.

"What is light pollution?", [retrieved on Apr. 19, 2007], retrieved from the Internet: http://www.Irc.rpi.edu/programs/nlpip.lightinganswers/lightpollution/lightPollution.asp, 34 pages.

Paulin, Douglas, "Full Cutoff Lighting: The Benefits", www.iesna.org, 3 pages.

"Simple Guidelines for Lighting Regulations for Small Communities, Urban Neighborhoods, and Subdivisions" [retrieved on May 16, 2008], retrieved from the Internet: http://www.darksky.org/mc/page.do?sitePageId=58881, 3 pages.

* cited by examiner

LIGHTING SYSTEM WITH COMBINED DIRECTLY VIEWABLE LUMINOUS OR TRANSMISSIVE SURFACE AND CONTROLLED AREA ILLUMINATION

I. CROSS-REFERENCE TO RELATED APPLICATIONS

This application claims priority under 35 U.S.C. §119 of provisional application Ser. No. 61/053,967 filed May 16, 2008, and provisional application Ser. No. 61/092,509 filed Aug. 28, 2008, which applications are hereby incorporated by reference in their entireties.

II. BACKGROUND OF INVENTION

A. Field of Invention

The present invention generally relates to exterior or interior illumination using architectural-system, often historical-style (hereafter sometimes referred to as "architectural and historical/architectural") light fixtures such as street lamps mounted on decorative posts, wall-mounted lights, acorn-style fixtures and similar fixtures. The present invention specifically relates to lighting systems or fixtures that provide the following: (1) a visible surface or light source (e.g. luminous surface/transmissive surface/visible lamp) or other source of reference illumination and (2) controlled task or area illumination for one or more targeted areas.

B. Architectural and Historical/Architectural, and/or Functional Lighting for Site Indication, Location Reference, and Task Lighting Architectural and historical/architectural fixtures as described above are used in many applications to provide a specific appearance, either as part of an overall theme or simply to provide aesthetic benefits to an area. Simplified examples of these types of fixtures are shown at FIGS. 1A-D. Of these types, the globe-style street lamp (FIG. 1A) and acorn-style street lamp (FIG. 1B) are very common. They can be supported/elevated on a variety of structures. Just a few examples for illustration are posts (FIGS. 1A and 2B) or wall brackets (FIGS. 1C and 1D). These fixtures have distinctive historical/architectural features, which are directly apparent both during daytime whether or not turned on and at night when turned on. They generally are intended to provide one or more benefits when used as illumination sources. First, they are intended to provide "site indicator/guide lighting" (hereafter "indicator lighting") from a "visible luminous surface light source" (hereafter sometimes referred to as "luminous surface") in order to provide a positive indication of designated areas, paths, or roadways. The distinctive architectural or historical style provides this indicator function during daylight hours. The style is similarly viewable when turned on at night, but the luminous aspects when turned on at night can also provide an indicator function. Second, they are most times intended to provide task lighting for targeted areas such as sidewalks, roads, or paths. That is, they are intended to provide some illumination of area around the light. Third, they can be intended to provide a source of reference illumination for nearby surfaces such as walls, doorways, and/or other visual surfaces in order to provide observers with a reference for location, distance, size, etc. The visible light source and illumination of the structure provide visible presence of the structure or features against its surroundings to persons in the area. However, fixtures such as FIGS. 1A-D have certain characteristics which leave room for improvement in the art, as will be discussed in more detail later.

The "lantern" style fixture of FIG. 1D uses frosted or clear glass in a similar fashion.

Another type of fixture that may be architectural, historical/architectural, or merely functional that is often used for nighttime illumination of structures is commonly known as a wall pack fixture (e.g. FIG. 1E). These fixtures are typically mounted to existing structures where electrical power is conveniently available. They can also provide indicator, task, and reference lighting. These fixtures also have certain deficiencies, which will also be outlined briefly below.

C. Light Distribution Pattern as a Deficiency of Architectural and Historic/Architectural Fixtures The optical design of many architectural and historical/architectural lights (e.g. FIGS. 1A, 1B and 1C) is normally not well adapted to providing task lighting due to its inherent light distribution pattern. In general, these fixtures use an upwardly oriented lamp and distribute light nearly omnidirectionally, with the exception that a lower supporting structure blocks light directed down from or near to the fixture. A relatively small amount of the light from the fixture is therefore able to reach the intended target. This will remain the case even if lamp brightness is increased in an attempt to overcome this deficiency. Additionally, much of the light is wasted by being directed upwardly.

D. 'Scene Brightness Ratio' as an Inherent Deficiency of Architectural, Historic/Architectural, and/or Functional Fixtures Due to well-known optical principles, the effectiveness of the task lighting is unavoidably reduced when a single luminous surface (e.g. the globe of FIGS. 1A, 1B and 1C, the panes of FIG. 1D, and the lens of FIG. 1E) is used to provide both indicator lighting and task lighting on a target area. It is known in the art that when light from these types of fixtures is reflected from a surface (e.g. ground and/or sidewalk, path, or street and/or floor X, FIG. 1F), that reflected light will always have a lower luminance than the original source of the reflected light which originates from a luminous source (such as from an architectural or historic/architectural fixture 10, FIG. 1F), since the luminous source will always be smaller than the reflecting surface in these applications. It is also known in the art (as will be discussed below) that the eye adapts to the brightest source of luminance within its field of vision (which in this example of FIG. 1F tends to be the luminous surface of fixture 10 at night when it is turned on). Therefore the eye will be less sensitive to the light reflected from the target area in FIG. 1F (e.g. surface X) than it would be to the direct luminance from the luminous surface (e.g. fixture 10 in FIG. 1F). The result is less visibility of the target area X in FIG. 1F (at any given luminance value of the single luminous source 10) in comparison, for example, to the visibility of a target area (e.g. X, FIG. 1G) wherein there is no luminous source visible to the observer such as, for example, just a directional task light 11 (FIG. 1G) which has no direct luminance to the viewer because its light source is shielded from direct view and its light output is directional. Another way of stating this principle is that the greater the 'scene brightness ratio' (i.e. the ratio of the brightest source of luminance in the scene vs. the luminance from the target area), the less effective will be the target illumination. This issue exists likewise for known fixtures like FIGS. 1D and 1E.

Thus architectural and historic/architectural lighting fixtures, by inherent design, are limited from providing effective target area illumination, particularly in comparison with a lighting fixture with a non-visible source of target illumination. Such fixtures by design create a 'scene brightness ratio' that causes the eye to adapt to the luminance of the luminous surface, which therefore relatively diminishes the effectiveness of the task lighting it provides. As illustrated in FIG. 1F, if the viewer has direct view of luminous source 10 when luminous source 10 has greater brightness than surface X, there is less visibility of surface X. On the other hand, FIG. 1G illustrates higher visibility of surface X if it is brightest in field of view (here no direct view or luminance shown), but there is no guide lighting that would otherwise be provided by the luminous surface.

E. 'Total Adaptive Range' and 'Scene Adaptive Range' of the Visual System

The ability of the human eye and visual system (hereafter "the eye") to adapt automatically to various levels of light has two separate but related domains: (a) Overall, the eye has a very wide 'total adaptive range' which allows useful visual perception over a very wide range of luminance levels. These levels can vary by a factor of easily 250,000:1 (possibly much more in some individuals). For example, starlight can have a light level of 0.001 lux, moonlight may be 0.3 lux, and full sunlight may be up to 100,000 lux. (The ratio between sunlight and moonlight can be on the order of 300,000 to 1; between sunlight and starlight as much as 100,000,000 to 1). (b) In general, the eye has a 'scene adaptive range' within which the eye can effectively perceive objects without undergoing an adaptive change. This scene adaptive range can vary between individuals and between ambient light conditions. For lower light or nighttime conditions, it may be on the order of 10:1 or 20:1; for daytime conditions it may be significantly higher, on the order of 250:1 or more. For very low light conditions approaching the lowest level of the eye's sensitivity, it may be lower than 10:1.

For purposes of applications of use, according to many aspects of the present invention, it is most important to note that the scene adaptive range of the eye determines the effectiveness of task lighting in an area. If the scene adaptive range of the eye is 10:1 (for a given location and ambient light level), then the brightest point in the field of vision should not be more than ten times brighter than the target area. Thus if the 'scene brightness ratio' (see discussion above) is 100:1 when the scene adaptive range of the eye is 10:1, the effectiveness of the target illumination will diminish, and subjective perception of glare and veiling luminance may occur. Efforts to increase the effectiveness of the lighting of the target area will therefore be subject to the constraints of the scene adaptive range of the eye.

Therefore, if the primary light source (e.g. the luminous surface) is quite bright compared to outdoor surroundings at night, a low level of illumination on the target that would otherwise be acceptable becomes insufficient. The eye has adapted itself to a bright light source that, unfortunately, has most of its effect on the eye, and little effect in providing useful light that is illuminating the target area. Thus, although the measured light level is relatively high, the usefulness of the light is very low.

Thus, any given lighting fixture for which the effective scene brightness ratio is greater than the scene adaptive range of the eye will, by inherent design, automatically tend to obscure the target area and tend to create conditions of glare or veiling luminance. Thus, for a fixture with an effective scene brightness ratio that is greater than the scene adaptive range of the eye, attempting to improve the visual effectiveness of the target illumination cannot be accomplished by either increasing or decreasing the luminance of the fixture, since the fixture's effective scene brightness remains outside the usable range.

Conversely, a fixture with an effective scene brightness ratio that is within the scene adaptive range of the eye, as will be detailed according to certain aspects of the present invention, will tend to provide effective and pleasing illumination of the target area, and will tend to allow use in widely varying ambient conditions since it will be seen that increasing the target area luminance can still be done within the scene adaptive range of the eye.

F. 'Glare' as a Visual Phenomenon

Certain terms in common use describe, non-scientifically, the effects of lighting sources that exceed the ability of the eye to adapt (see discussion of eye adaptivity above). For instance, the term 'glare' loosely describes various undesirable effects resulting in reduced vision and unpleasant or painful observer experiences. Depending on the circumstances, glare may be categorized as 'discomfort glare', 'distracting glare', 'disabling glare', or 'blinding glare'. (Other nomenclatures may be in use as well.) The term 'veiling luminance' is similarly used to describe a condition in which a source within the visual field of an observer is sufficiently bright such that other objects are visually obscured. Both effects are attempts to describe the visual effect of circumstances wherein the source of direct luminance is brighter than the surrounding field of vision in excess of the eye's ability to adapt.

Anecdotally, these conditions are well known to most people from the experience of driving on a 2-lane highway and meeting a vehicle with its headlights on high beam. Ambient conditions determine whether the glare and veiling luminance is perceived. If it is bright sunlight, the light from the headlights may be nearly imperceptible; under cloudy or twilight conditions, the light from the headlights is perceptible, but not distracting. However on a very dark night, the light from the headlights can be, for various people, uncomfortable, distracting, disabling, or even blinding. Thus the perceived brightness of the headlights, and any perception of glare or veiling luminance, occurs based on the source of glare being significantly brighter than the brightest source of light to which the eye was previously adapted.

G. 'Design for Glare' in Architectural and Historical/Architectural Fixtures

Because architectural and historical/architectural fixtures are intended to function as indicator lights—which by definition must be directly visible in the observer's field of view—these fixtures must radiate light almost omni-directionally. This tends to result in undesired visual effects ('glare') for the observer. For the observer in the target area who is experiencing the effects of glare, efforts to increase target area illumination by increasing the radiated light from the fixture tend to be counterproductive because it is recognized that (again, by design) these fixtures provide relatively poor target illumination and this does not change the 'scene brightness ratio' relative to the scene adaptive range of the observer's eye and therefore does not increase the effectiveness of the task lighting (and may in fact make the task lighting less effective relatively) but may increase the perception of glare.

For observers outside the target area, existing historical/architectural fixtures can also cause unintended negative effects. As previously noted, much of the light goes in directions other than the target. This 'spill light' contributes to well-known issues with light pollution in the immediate vicinity as well as contributing to societal concerns such as night sky glow and reduction of nighttime sky visibility.

For examples of standard industry references to these concepts, refer to IESNA ED-100, pp 2-14, 2-15 available from Illuminating Engineering Society of North America; CIE publication 112-1994 available from the International Commission of Illumination (CIE); and IESNA TM-11-00 available from Illuminating Engineering Society of North America; each incorporated by reference herein.

H. Efficiency of Architectural and Historical/Architectural Fixtures

Existing architectural and historical/architectural fixtures may be quite inefficient for several reasons: These fixtures typically use incandescent or high intensity discharge type lamps, ranging in power from 100 to 400 watts or more, and are physically of a size that would be difficult to include as a task light without disrupting the historical and/or architectural aesthetics of the light. Compared to other types of fixtures with the same power usage, only a small percentage of the light output is typically used to light the target area, due to the non-controlled nature of the illumination provided. In addition, glare from such fixtures reduces the effectiveness of the small amount of available illumination. Therefore, very high power levels relative to other types of fixtures can be required to provide (somewhat) effective illumination of the target area.

I. Cutoff Type Fixtures Ineffective as an Answer to Deficiencies in Architectural and Historical/Architectural Fixtures As an answer to the aforementioned deficiencies in the art, "cutoff type fixtures" have been proposed as a solution. These types of fixtures are classified based on their effectiveness at controlling the amount of light radiated near horizontal (i.e. near 90° from nadir). Typical classifications range from (a) 'semi-cutoff,' which provides little means for limiting light intensity near horizontal, (b) 'cutoff,' which limits the light intensity at 80° from nadir to be 10% or less of rated lumens and which limits intensity at 90° to be 2.5% or less of the rated lumens, and (c) 'full-cutoff,' which limits the light intensity at 80° from nadir to be 10% or less of rated lumens and which limits light intensity at or above 90° from nadir to zero.

These types of fixtures generally do not adequately address the deficiencies in the art. First, there is usually a trade-off of historical/architectural character to achieve improved function. Second, these types of fixtures still allow some light at or near 90° from nadir (i.e. essentially, light still may travel horizontally), causing glare. Thus the eye's involuntary adaptive response can be triggered which reduces effectiveness of the illumination. (Examples of cut-off type fixtures and full-cutoff type fixtures are described and shown at www.lrc.rpi.edu/programs/nlpip/lightinganswers/lightpollution/lightPollution.asp and "Full Cutoff Lighting: The Benefits" at www.iesna.org. Third, the loss of the historical and architectural transmissive or luminous surface represented by the globe, acorn, panels, etc. causes a loss of the guide/indicator function during both daytime and nighttime hours.

J. Dark Sky Regulations

"Dark sky regulations/recommendations" are ordinances or industry standards which seek to reduce night sky glow, allowing better visibility of the nighttime sky and reducing the effects of unnatural lighting on the environment. An example of dark sky recommendations is found in the "Simple Guidelines for Lighting Regulations for Small Communities, Urban Neighborhoods, and Subdivisions" from the International Dark-Sky Association (http://www.darksky.org/mc/page.do?sitePageId=58881), incorporated by reference herein). The present invention proposes means to accommodate dark sky regulations/recommendations while preserving desired aesthetic qualities.

K. Color, Color Temperature, and Color Rendering Index (CRI)

Color, color temperature, and color rendering index (CRI) of lighting are all very complex subjects, but well-known to those skilled in the art. A limited discussion concerning the transmission and perception of color with reference to color temperature and CRI follows. First, visible light is a portion of the electromagnetic spectrum that can be perceived by the eye, generally considered to have a wavelength ranging from about 400 to 700 nm. Although the colors run as a continuum from shorter to longer wavelengths, 'color' as a physical phenomenon generally refers to a particular wavelength or range of wavelengths within the visible spectrum. One standard division of the spectrum is as follows: violet 400-450 nm, blue 450-490 nm, green 490-560 nm, yellow 560-590 nm, orange 590-630 nm, red 630-700 nm.

Light, such as sunlight, having a relatively even distribution of the wavelengths from 400-700 nm is perceived of as 'white.' White light may be described in terms of its 'color temperature', which is based on the distribution of wavelengths generated by a 'black body radiator' at a specific temperature on the Kelvin scale. A color temperature of 2800 K, such as emitted by an incandescent light bulb, while nominally 'white' has a reddish-yellow tinge. Typical daylight has a color temperature of 5500-6000 K. An overcast sky will typically have a color temperature around 6500 K. (Paradoxically, by convention, observer perception of 'warmth' or 'coolness' of the light is inverted with relationship to the actual temperature of the black body radiator. The light from an incandescent bulb at 2800 K is said to be 'warmer' than the physically much hotter overcast light at 6500 K which is described as "cool white.").

Color Rendering Index (CRI) is a measurement of how colors are perceived by the eye when viewed under differing light sources. Incandescent light is given the standard value of 100 and other light sources are compared with their ability to render colors with the same observer perception, with higher (approaching 100) being 'better', at least by convention.

Architectural and historical/architectural fixtures which normally have a single light source can generate light of any particular color, color temperature, or CRI that is within the range of lamp technology, however as a single fixture they are limited to the rating of the lamp that is installed. Thus for aesthetic purposes, a low color temperature of 2800 K may be desired so that the transmissive or luminous surface looks 'right' for the scene. However, task lighting might render surroundings more effectively or pleasingly if a different color temperature could be used. Likewise, there could be reasons to vary color or CRI (or other characteristics not herein enumerated) of luminous surface lighting versus task lighting.

For example, a luminous surface biased towards a lower color temperature or redder color could provide a reference luminance that allows a relatively low eye adaptation response. At the same time, target illumination that is biased toward a higher color temperature or bluer color could provide improved effectiveness of target area illumination.

Thus, it is a deficiency of existing architectural and historical/architectural lights that they cannot ordinarily provide differing color temperatures, colors, or color temperatures, or other characteristics for the luminous surface and the task lighting. A fixture that can do so, as will be discussed below, would be a distinct improvement in the art.

As can be seen from the foregoing discussion, there is room for improvement in the art.

III. SUMMARY OF THE INVENTION

It is therefore a principle object, feature, advantage, or aspect of the present invention to improve over the state of the art.

It is a further object, feature, advantage, or aspect of the present invention to solve problems and deficiencies in the state of the art.

Further objects, features, advantages, or aspects of the present invention include an apparatus, method, or system of lighting units providing a directly viewable luminance and task light illumination such that the luminance value to which the eye adapts itself is a result of the illumination of the intended target area, rather than the luminance of the light source itself.

Further objects, features, advantages, or aspects of the present invention include an apparatus, method, or system of lighting units providing a directly viewable luminance and task light illumination such that another luminous source may be included for its architectural or positioning value ('reference light'), so that the eye is adapted to the luminance from the target area illumination, and so that the luminance of the visible light source is included within the 'scene adaptive range' of the eye. Alternatively, instead of two sources, a specific configuration of the luminous source may separate or direct portions of the light such that it both provides illumination of the intended target area as well as a luminous source which is appreciated for its architectural or positioning value.

Further objects, features, advantages, or aspects of the present invention include an apparatus, method, or system of lighting units providing a directly viewable luminance and task light illumination such that the illumination level of nearby surfaces is controlled by a first lighting source which may be separate from a second or task lighting source or which may utilize optical or other components to provide both task and reference lighting from one lighting source, and which may be the luminous surface, a transmissive surface, or a visible lamp (luminous surface/transmissive surface/visible lamp), and which light source may be attached directly or nearby. For purposes herein, the term "luminous surface/transmissive surface/visible lamp" refers to several options or variations for what is sometimes referred to as the primary light or light source (as compared to what is sometimes referred to as the secondary or directional task light or source). Either can take many different forms and characteristics. The term "luminous surface/transmissive surface/visible lamp" is intended to convey that at least some forms or characteristics of the primary light or light source can include, but are not limited to, a luminous surface (e.g. a translucent globe or panel which is back-lit by a light source of the fixture, or a wall or other surface that is illuminated by a light source of the fixture), a transmissive surface (e.g. a light transmissive surface including but not limited to translucent or transparent material), or a visible lamp (e.g. a directly visible light source such as a solid state, incandescent, fluorescent, or other light source or sources).

Further objects, features, advantages, or aspects of the present invention include an apparatus, method, or system of lighting units having a directly viewable luminance and task light illumination such that (a) luminance of the target area (i.e. the light reflecting to the viewers eyes directly from the target area) is the luminance level to which the eye adapts, and that (b) the luminance from the luminous surface/transmissive surface/visible lamp is at or below that level, so that the eye receives maximum utilization of the task lighting of the targeted area, and that (c) the light source of the task light (if a separate source from the reference light source) is not in the normal field of vision, or if the same source, the portion or most of the portion of the single light source which is used to provide task lighting, is not in the normal field of vision.

Further objects, features, advantages, or aspects of the present invention include an apparatus, method, or system of plural lighting units providing a directly viewable luminance and task light illumination such that the transmissive or luminous portion of the lighting units, when viewed by the average observer, appear to be single light sources of the general nature and character of historical and/or architectural appearance.

Further objects, features, advantages, or aspects of the present invention include an apparatus, method, or system that selectively controls, with multiple light sources, or with multiple aspects of a single light source, the relative luminance and illumination of (1) a luminous surface/transmissive surface/visible lamp and/or (2) the illumination of nearby surfaces on which the light source is attached directly or nearby, thereby providing a reference of shape, place, etc. (e.g. for objects such as building walls or doorways); and/or (3) the illumination of the targeted illumination area (such as a walkway or other area).

Further objects, features, advantages, or aspects of the present invention include an apparatus, method, or system of lighting units such that the benefits of a luminous surface/transmissive surface/visible lamp are obtained separately from the benefits of the task illumination function which is provided with separate task lighting.

Further objects, features, advantages, or aspects of the present invention include an apparatus, method, or system of lighting units which provides historical and/or architectural benefits for day and night time, including visual daytime or luminous night-time demarcation of areas, routes, or zones by repetition of identical or similar fixtures with historical or architectural features. Additionally it provides targeted illumination, provides ancillary visual light at low but efficacious levels, provides a reference for the eye, provides dark adaptation benefits for the eye, and provides a ratio of luminance ('scene brightness ratio') between reflected luminance from the target and the primary light that may be on the order of 100 to 1 or less (or that may be of a greater or smaller ratio depending on application and conditions), which could be within the 'scene adaptive range' of the eye. These effects could provide one or more of the following benefits: increase apparent effectiveness of lighting, provide or preserve historical/aesthetic lighting while minimizing glare and up lighting, provide a pleasurable ambience, and/or provide night time reference and/or positioning of objects such as building walls or doorways. Additionally, it could minimize undesired effects such as glare and up lighting, save energy, allow use of various types of light sources, and control light pollution and dark sky issues.

A method according to one aspect of the invention comprises a means of illuminating an area using fixtures which include a luminous transmissive surface (e.g. diffuse, prismatic, etc.) and a task light which is functional but not readily visible. The transmissive surface luminance compared with reflected task luminance could be of a particular ratio. Alternatively, the method can include a luminous surface/transmissive surface/visible lamp in combination with a task light for providing lighting. Still further the method could include creating at least one of a luminous surface/transmissive surface/visible lamp and creating task lighting which is functional but not readily visible.

An apparatus according to an aspect of the invention comprises a first light source generating a directly viewable luminous surface/transmissive surface/visible lamp which could be a luminous member such as a globe or similar member, and a second light source, not generally directly viewable, or second portion or aspect of the first light source, generating directional illumination (task lighting) of a target at or near the apparatus. In general, the light source providing task lighting is concealed within a shape that appears to be the same or similar to the original type of the fixture. This shape may be part of the structural or decorative portion which would otherwise (i.e. in its original historic/architectural form) not be a source of luminance. Alternatively, the shape which conceals the task light source may be part of the luminous globe or member (or other luminous surface/transmissive surface/visible lamp). The sources for producing the luminous globe or member, or luminous surface/transmissive surface/visible lamp, as well as for the task light, could be LED lights, other solid-state lights, or other types of lights, which could provide light at calculated power levels, which could be low power levels compared with existing fixtures. The ratio of the reflected task luminance compared with transmissive surface luminance or a luminous surface/transmissive surface/visible lamp could be within the 'scene adaptive range' of the eye, which could be on the order of from approximately 100:1 down to 1:1 (i.e. task: transmissive surface luminance). One ratio (depending on conditions of installation and use) could be on the order of 5:1 or 6:1. Other ratios could be used depending on application and conditions.

A system according to an aspect of the invention comprises a plurality of the above-described apparatus placed at spaced-apart locations around or within an area to be lighted.

These and other objects, features, advantages, or aspects of the present invention will become more apparent with reference to the accompanying specification.

IV. BRIEF DESCRIPTION OF THE DRAWINGS

V. DETAILED DESCRIPTION OF EXEMPLARY EMBODIMENTS

A. Overview

Figure 1A:
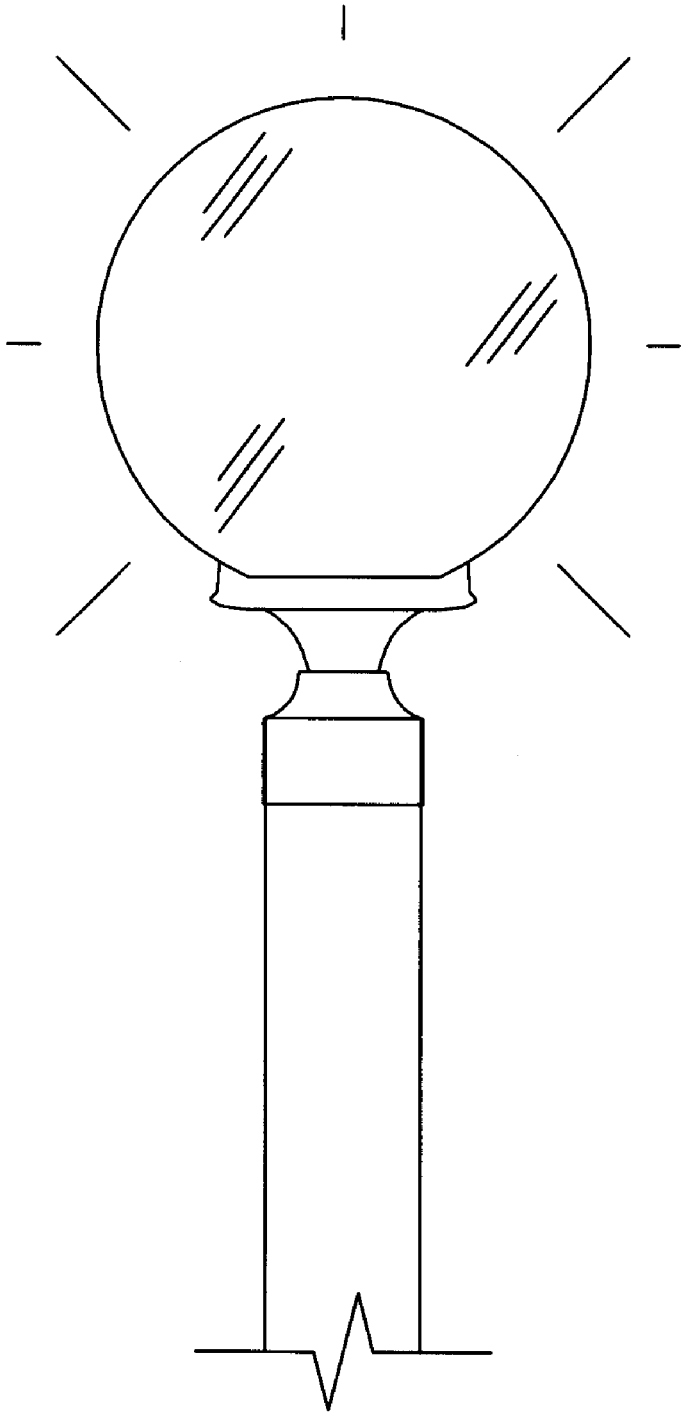
FIG 1A (PRIOR ART)
FIG. 1A illustrates a typical globe type fixture.

For a better understanding of the invention, several forms that aspects of the invention can take will be now described in detail. These are for illustrative purposes and are not inclusive or exclusive of all forms the invention can take. The scope of the invention is defined by the appended claims.

A method, system, and apparatus is provided which uses (a) at least one luminous surface/transmissive surface/visible lamp, one specific example being one or more glowing sources of a predetermined luminance (that may be comparatively low), in order to provide a perceived light source, in combination with (b) a task source which is not readily visible as a source of light (apart from reflection off of atmospheric particles). The glowing source may be of a design that has historical/architectural value for both nighttime and daytime. The light from the task source is intended to be projected to a specific area and to provide even illumination for specific targets, including but not limited to walkways and sidewalks (e.g. refer to FIGS. 2B and 2C). Because of the eye's adaptive characteristics, the globe or other luminescent member appear to the eye similarly bright as if it were the source of task lighting, while the surface (e.g. ground X in FIG. 2G) which is the targeted illumination objective, is efficaciously rendered by the actual task lighting (see illustration of FIG. 2G).

This method, system and apparatus may be used for replacing, retrofitting, or providing new fixtures. These fixtures may, in comparison to existing fixtures, (a) maintain the historical character/appearance and luminous appearance of globe, 'acorn,' 'lantern' or similar styled lights (or provide an historic look and luminous appearance with the use of new lighting fixtures), (b) provide the benefits of historical/architectural fixtures (which may include both aesthetic benefits as well as functioning as indicators or guides), (c) create illumination that is efficacious in the target area, (d) reduce glare, spill, and/or light pollution, and/or (e) increase efficiency. Additionally, by optionally allowing use of long-life and low power LED or other solid state lighting sources it may (f) potentially reduce maintenance costs, (g) further increase efficiency, and/or (h) allow improvements in the selection of color or color temperature of the luminous surface indicator or reference or primary light and/or the task light.

B. Scene Brightness Ratio, Indicator/Guide Function within Scene Adaptive Range (Reducing 'Glare')

The exemplary embodiments illustrated in this application include a primary light with transmissive or luminous surface(s), which serves as a daytime and nighttime indicator or guide. It is a feature that the embodiments are designed to operate in typical low light or night time uses so that the 'scene brightness ratio' (of the luminance from the target area, which is created by the task light source of the fixture, compared to the luminance of the transmissive or luminous surface(s)) is within the 'scene adaptive range' of the eye, such that the eye may adapt to the luminance from the target area, rather than the luminance from the transmissive or luminous surface; thus providing an important indicator/guide function without the deficiencies of existing art. It is to be noted that analogous "luminous source" effects can be obtained either by a primary light which comprises a visible light lamp or light source, or by an adjacent wall or other surface which is luminous by illumination from the primary light.

As a feature in the embodiments discussed (and as a corollary to the relatively reduced brightness of the indicator/guide light), the exemplary embodiments illustrated in this application take advantage of the eye's ability to adapt to lower light levels by providing a source of "secondary" task lighting that is separate from the source of direct or primary light and which is not readily visible to the ordinary observer. This tends to reduce or eliminate the perception of 'glare' from the fixture, since (a) the luminance from the target area illuminated by the "secondary" task lighting is generally the brightest in the observer's field of vision, (b) as outlined above, the luminance from visible transmissive or luminous surface (the primary source providing indicator/guide light) is less than the luminance from the target area illuminated by the "secondary" task lighting, and (c) the source of task lighting, while necessarily brighter than the task lighting luminance which it provides, is not visible and therefore does not become the point of eye adaptation.

The present invention has been observed to work within a ratio of luminance ('scene brightness ratio') between reflected luminance from the target and the primary light that may be on the order of 100 to 1 or less (or that may be of a greater or smaller ratio depending on application and conditions), such that the ratio of the reflected task luminance (from the secondary lighting) compared with transmissive or luminous surface luminance (from the primary lighting) could be within the 'scene adaptive range' of the eye. This can potentially allow much lower levels of illumination, but is useful at any level of illumination, as long as 'scene brightness ratio' is kept within the 'scene adaptive range' of the eye. As the precise ratios for human eye adaptivity can be subjective and variable (e.g. according to actual scene brightness), and because differing effects could be desirable, various ratios could be possible depending on the particular application.

The aforementioned conditions are achieved by designing the fixture such that the angle of emittance of the task light source is outside of the normal field of vision of the observer. It is known in the art that human vision generally comprises a visual field that extends 180° horizontal and 130° vertical, 60° above horizontal and 70° below horizontal. (See, e.g. "Lighting Handbook", Philips Lighting Company, Somerset, N.J. USA, Copyright 1984). In general, the normal angle of viewing for most activities is much less, even down to less than 10 from center for fine detailed viewing. However, the level of brightness of objects in the visual field can be detected by the eye, even at the outer limits of the visual field. This means that a source designed with an emittance angle from horizontal of 60° or greater (i.e. an emittance angle of 30° or less from nadir) completely removes direct light from the upper field of view. Since the light source is removed from the upper field of view, it is not sensed by the eye and therefore does not become the source of eye adaptation. However, the 60° upper viewing angle is more of the upper limit than the typical viewing angle, which is generally less severe. In other words, as an easily visualized example, a source with an emittance angle of 45° from horizontal will not ordinarily allow the light source to be seen by a person at typical viewing angles.

Selection of the ideal emittance angle also allows for the fact that although human field of vision can perceive up to 60°, an emittance angle from horizontal of approximately 38° has been observed to be acceptable as a typical field of view for fixtures of the type described herein, thus an angle between 60° and 38° may be acceptable.

C. Increasing Background Visibility/Reducing 'Veiling Luminance'

The present embodiment makes it possible to provide highly effective task lighting, indicator/guide lighting, and reference lighting at light levels that are appropriate to ambient levels of light, since unlike existing art, the 'scene brightness ratio' of the fixture can optionally be kept within the 'scene adaptive range' of the eye. Task lighting levels can be set so that they are the highest level of brightness in the observer's field of vision. While desire or need for high levels of illumination of the target area may override the desire not to obscure the background, if conditions allow it, unlike existing art, these lighting levels may not need to greatly exceed ambient light levels, whether in a relatively bright urban setting or in very dimly lit rural or park type setting with mostly starlight or moonlight present. Thus the scene outside the target area need not be obscured by high levels of light. Objects in the distance with a low illumination level may still be within the scene adaptive range of the eye and therefore will be visible, rather than obscured as by existing fixtures. This can result in reduction or elimination of the perception of 'veiling luminance' and provide a much more pleasant night-time viewing experience.

D. Determining Lighting Values

1. Determining baseline values

While it is possible to suggest values for various fixture parameters such as lamp lumens, transmissive source luminance, lamp height, etc., it is also possible to select or design light sources according to actual conditions. It is necessary to know:

normal ambient light levels at normal lighting times.

type/reflectivity of target surface.

desired target 'brightness' relative to ambient light level.

mounting height and optical configuration.

Once these things are known, the illumination required to achieve the desired brightness may be calculated according to well-known principles in the art.

Figure 9A:
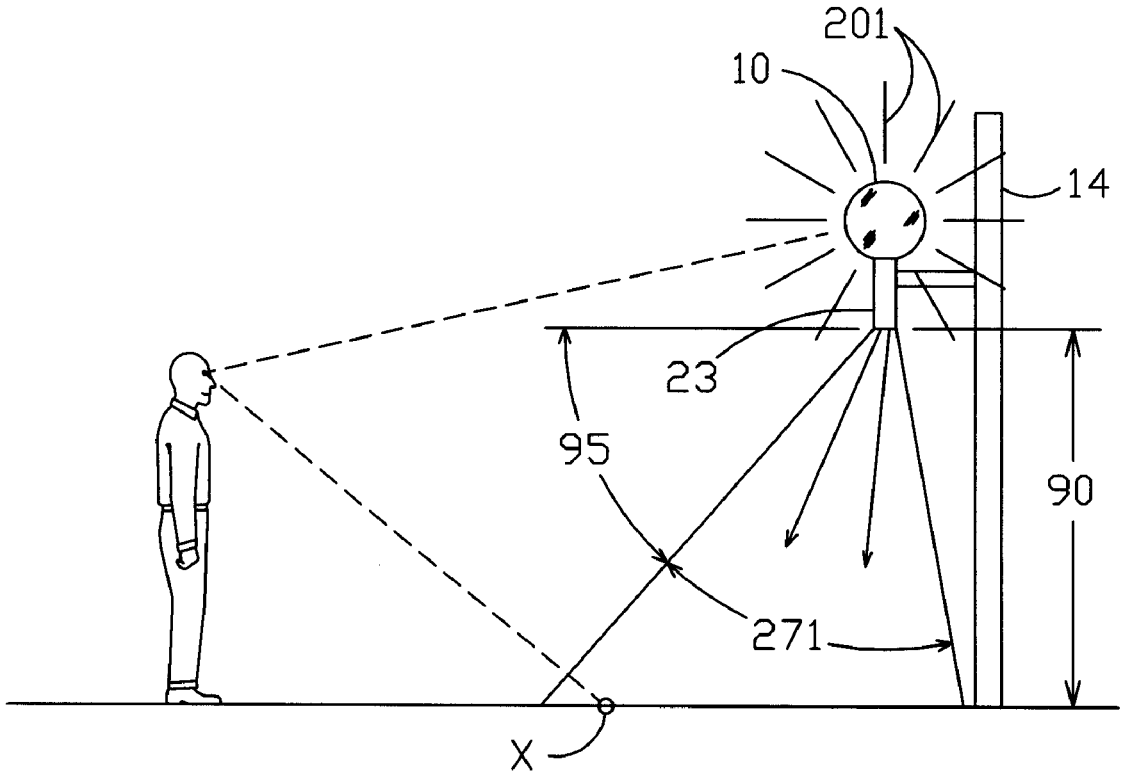
FIG. 9A is an illustration of a relative brightness between a lighting unit like that of FIG. 2A and the ground around it with respect to a given mounting height.

2. Calculating Target Illumination (FIG. 9A)

At low light levels (e.g. below approximately 1 fc), a luminance from the target area of approximately 2 to 2½ times ambient light level can be considered optimum; however a minimum luminance of approximately 0.25 fc is considered necessary.

For example, given a background light level of 0.03 fc, roughly equivalent to moonlight, 2½ times that level is 0.075 fc. This level is less than the minimum 0.25 fc, so 0.25 fc is chosen for target luminance desired level.

The following formulas may be used:

B=background illumination in $lm/ft^2$.

F=desired target illumination level ($lm/ft^2$).

F is the greater of (2.5*B) and 0.25 fc.

H=fixture mounting height.

S=the illuminated target area square footage.

A=reflectivity of the target area where $0<A<1$ (typical value=0.5).

$S=pi*r^2$ (or, S=area of target area by other calculation if not circular).

r=H*tan(90-E), where E=emittance angle from horizontal.

L=quantity of reflected light.

L=F lm/ft$^2$*S ft$^2$/A.

Given a desired mounting height H of a fixture of ten feet, a fixture evenly lighting a circular area and having a emittance angle E of 38° from horizontal, assuming a 50% reflectivity of the target surface, and near 100% effective transmission of light to the target (values are rounded to reflect typical levels of precision appropriate to the industry.

r=10 ft*tan 52=12.799; r=12.8 ft.;

S=3.14*12.8*12.8=514.46; S=500 ft$^2$

L=0.25 lm/ft$^2$*500 ft$^2$/0.5=250 lumens

Therefore, given 100 lumens/watt efficiency for some LEDs, two LEDs driven at 1.25 watts each would be installed to provide target lighting.

3. Calculating Luminous Surface Illumination (FIG. 9A)

The luminous surface must give the impression that it is "glowing," which produces the perception that it is also the source of the target illumination. It must not exceed the appropriate scene adaptive range for the eye, and for best visual effect, it should not appear "too dim" or "too bright." Therefore selecting the best luminance level for the luminous surface is can be somewhat subjective, given the extreme range of physical locations and ambient conditions for these fixtures. However, it is simple to calculate an appropriate range that will provide a very useable range which may be used as a basis for more subjective determinations. A simple rule for determining luminous surface luminance is that it must appear to be "brighter than the background, but not as bright as the target surface." Thus given a mounting height and background light level for the intended location, a luminance value N for the luminous surface may be specified.

N is desired luminance in fc of the luminous surface

F/6<=N<=F

D is the diameter of a transmissive globe surface

T is the transmissivity of the globe surface; 0<T<1

For example, given the (B=0.03, F=0.25) the required luminance of the source of the luminous surface may be estimated as follows:

Given previous conditions:

a background light level of 0.03 fc 0.25 fc target luminance F desired level the luminance N fc of the luminous surface should be between F/6 and 0.25 fc; i.e. between 0.04 and 0.25 fc.

0.10 fc may be selected as an intermediate value.

Therefore, given that

Surface is diffusive luminance is measured in lumens/steradian lm/sr is equivalent to 1 fc/ft$^2$ a sphere has a surface area of 12.57 steradians total lumens L of an evenly radiating source inside a sphere/12.57=lumens L per steradian (L/12.57=fc)

a single LED emitting X lumens evenly on the surface of the globe will emit X/12.57 lumens on one steradian area Further, given that a two foot diameter globe (d=2 ft) has one square foot surface area per steradian, therefore 1 lm/sr is equivalent to 1 fc/ft$^2$ Total footcandles X/12.57=N fc/sr X=12.57*N (not compensated for transmissivity)

Transmissivity 'T' of the surface 50%; luminance of source will need to be multiplied by 1/T

1/T=2

X=12.57*N*2 (compensated for transmissivity)

X=12.57*0.10*2

X=2.5 lumens required source given 100 lumens/W for some LEDs, an LED rated at 0.025 W is required.

For a one foot in diameter globe and a desired 0.25 fc, the surface area equivalent to one steradian has an area of 0.25 ft$^2$, therefore 0.625 lumen would be sufficient to illuminate the globe at a 0.1 fc intensity This formula may be easily modified given differing luminous surfaces and characteristics of LED light sources. The size and shape of the luminous surface (e.g. globe, lantern, acorn, etc.) will change according to community and architectural considerations, and the transmissivity will vary according to the composition of the luminous surface. The LED source may be configured and mounted variously to provide differing effectiveness of delivery to the luminous surface For applications with higher background luminance levels, the luminance N of the luminous surface may vary more widely, given a wider acceptable scene brightness ratio for brighter backgrounds, keeping in mind that the luminous surface luminance should be greater than the background luminance but less than target area luminance.

It should be noted that other factors can influence the desired brightness of the luminous surface which may necessitate modifying calculations. For instance, the luminous surface tend to be noticed by viewers at some distance which means that a change in height results in very little difference to distance from the viewer; conversely a viewer close to the luminous surface (where a difference in height would make a greater distance in perceived brightness) is unlikely to be seeing said surface. In other words, while target luminance is directly proportional to the square of the mounting height (other factors being equal), the appropriate luminosity of the luminous surface is more directly related to ambient light levels, and less directly related to the height of the luminous surface.

A related consideration is the fact that while increasing the height of the luminous surface does somewhat diminish its luminance, on the other hand the background for a higher luminous surface is more likely to be a dark sky rather than a collection of lights in the background. This means that a luminous surface which is higher may require less luminance to provide the same benefits.

These considerations will also vary depending on the type of fixture providing a luminous surface and the desired effects therefrom. A wall pack type fixture will have different characteristics and typical mounting locations than a globe or acorn-style fixture.

E. Exemplary Method and Apparatus Embodiment 1

1. General System and Method of Embodiment 1

By referring to FIGS. 2A-2E, a first exemplary embodiment according to one or more aspects of the invention will now be described.

Figure 2A:
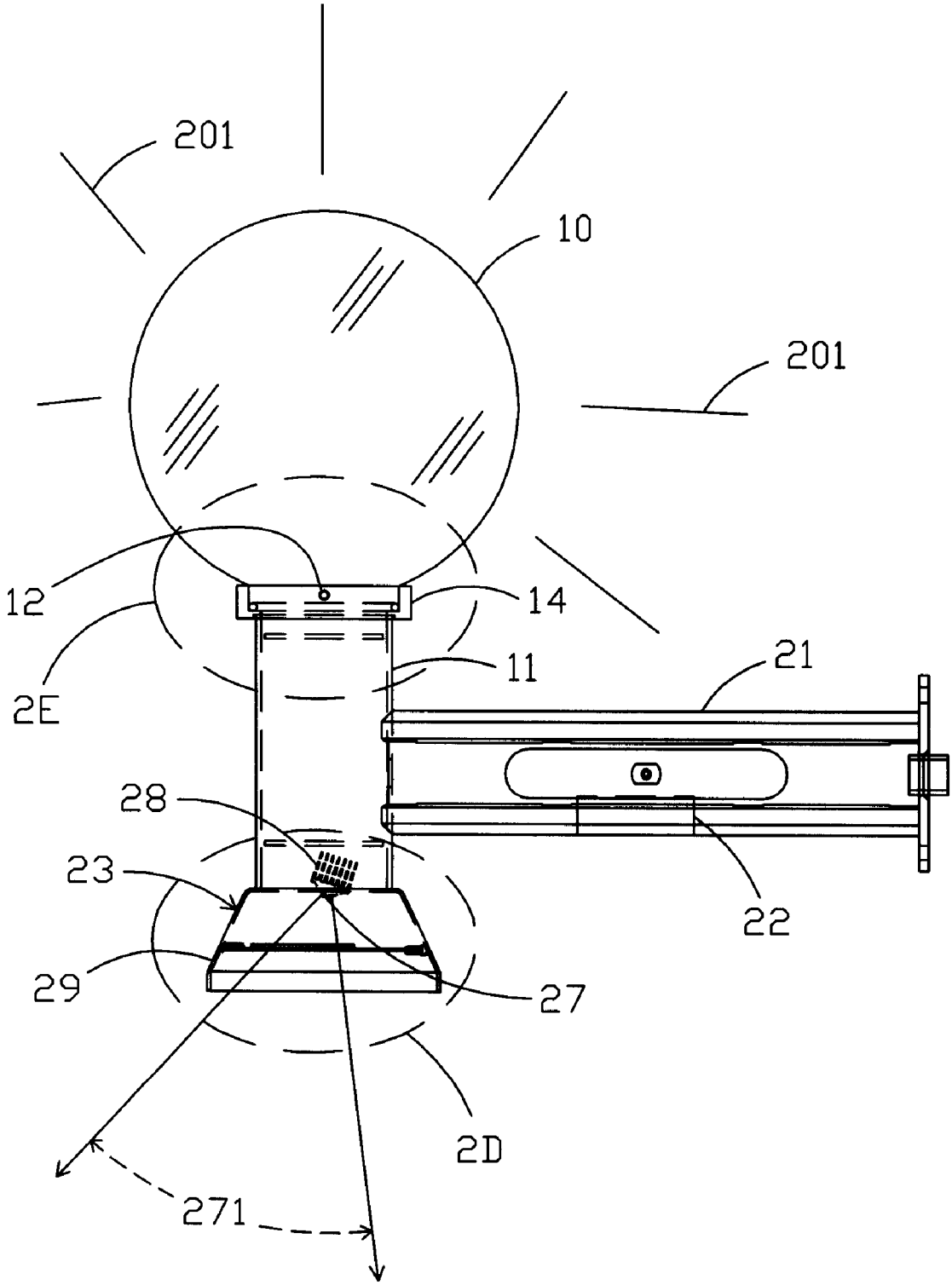
FIG. 2A illustrates a first embodiment of the present invention.

Light source 20, (FIG. 2E) illuminates globe 10 as seen in FIG. 2A in a manner that produces direct lighting through a transmissive or luminous surface that is substantially omnidirectional (see lines 201), but with a relatively low level of luminance in comparison to existing fixtures and in comparison to the task lighting provided by luminaire 23 (see also FIG. 2D), such that it does not exceed the reflected luminance of the illuminated target surface by a certain amount. In one example, globe 10 can be on the order of 1-2 feet in diameter.

Light source 20 could optionally be a very small light source such as a fractional watt LED light (FIG. 2E) or other relatively low power light source. An observer at most positions at or near the area being illuminated can comfortably observe the globe 10 and its relatively low level luminance. This produces a comparatively low reference level for the observers' eyes, such that such observers are not caused to undergo visual adaptation from the reference light, relative to the background illumination or to the target illumination, which could render the task (target) lighting less effective. It could also cause the globe 10 to glow sufficiently to give the impression to a passerby or observer that conventional globe-style lighting fixtures (e.g., FIG. 1A) are in place. This level of luminance would also reduce their contribution to various forms of light pollution.

In addition to the conventional looking globe 10, an additional, functional and non-intrusive luminaire (the lower luminaire 23) that places the light source outside of the typical field of view of persons in the area and within the acceptable emittance angle is mounted as part of the globe-holding fixture of FIG. 2A. This luminaire 23 provides the target illumination, which is suggested visually by the glowing globe 10. The luminaire 23 could provide a level of lighting that has a specific luminance level in relationship to the direct lighting provided by the transmissive or luminous surface. The illumination from luminaire 23 could be provided by one or more LED lights 27, other solid-state light sources, or conventional light sources. This could improve the perceived level and quality of the task lighting provided by the lower luminaire 23 which is described below (see also FIG. 2D). For a typical application, the level of lighting of luminaire 23 might be that provided by approximately five 1-watt high efficiency LED lights.

A further result is that the area surrounding the target which is intentionally not significantly illuminated by the task light could be much more visible, since (depending on the embodiment) there could be a much lower level of overall light, which could reduce the eye's adaptation response, and since glare and veiling luminance could be substantially reduced or eliminated.

Figure 2B:
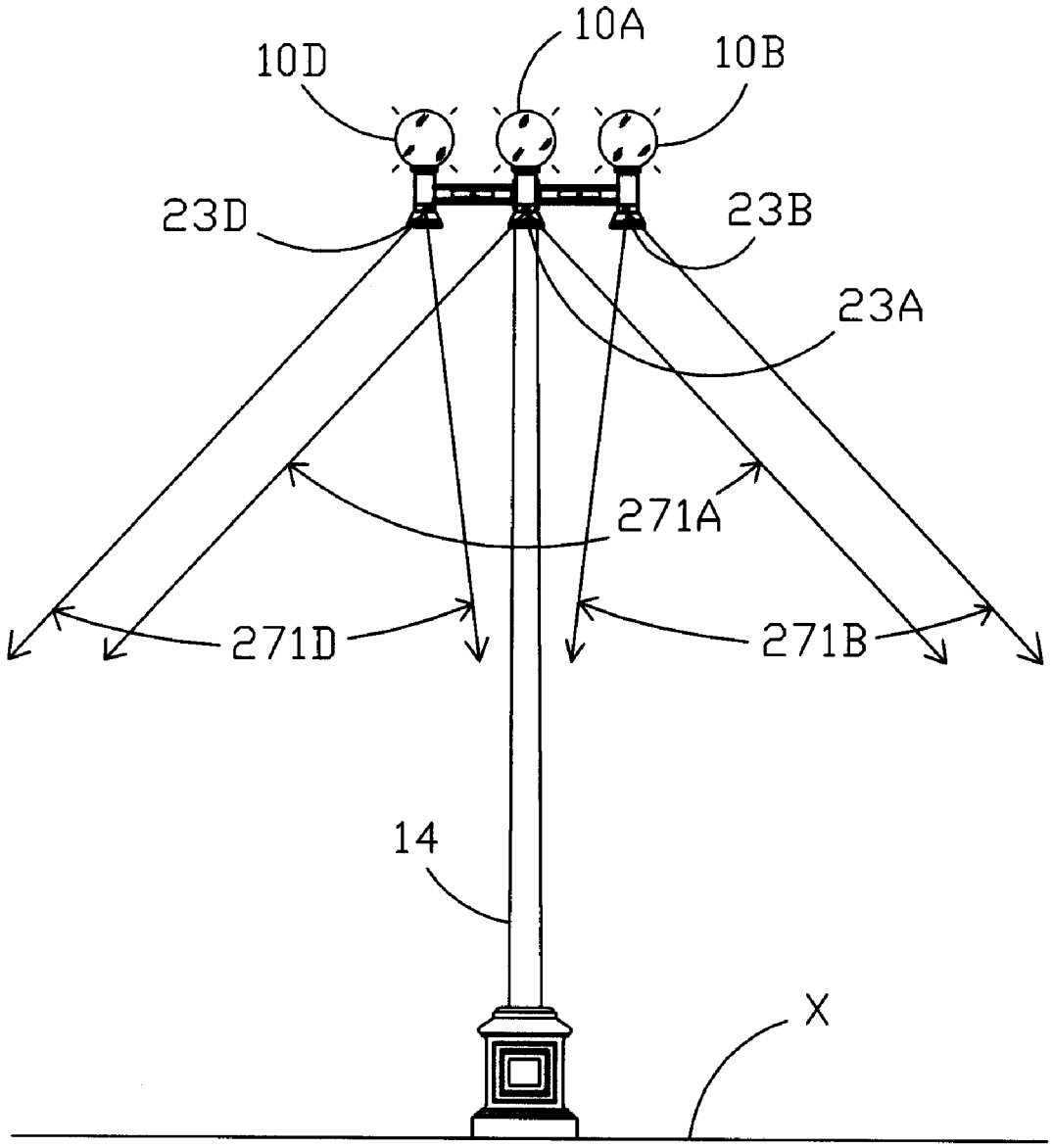
FIGS. 2B and 2C illustrate a typical application of a plurality of the first embodiments of FIG. 2A.
Figure 2C:
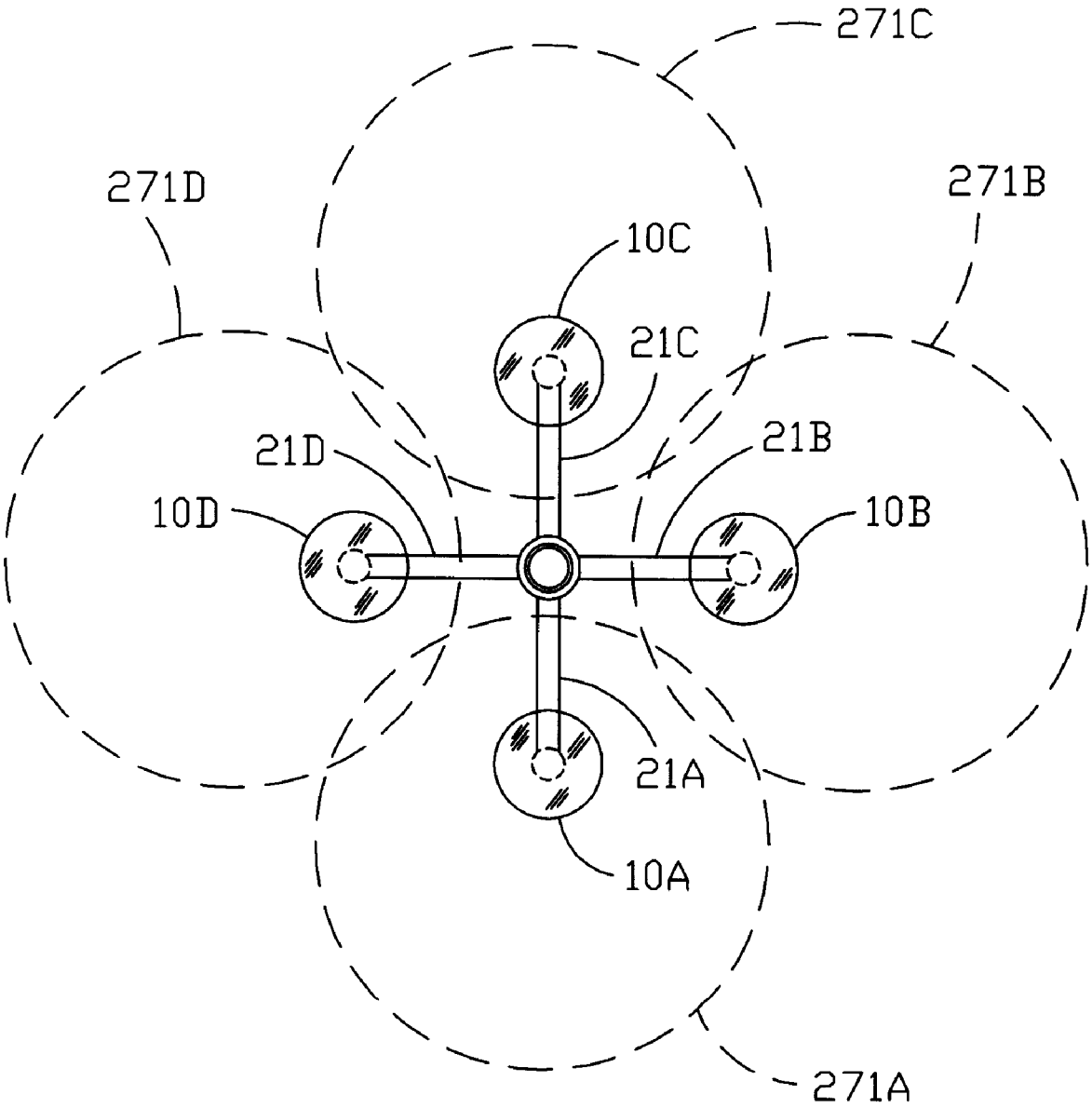

Plural units like FIG. 2A could be used over a broader area. Placement of each of the dual-light source (globe and task) light units of FIG. 2A would be calculated based on known principles of lighting in order to provide a level of light that is designed for optimum illumination and perception of illumination of the targeted areas to be illuminated. Other benefits as discussed above are amplified and multiplied in lighting installations that use plural fixtures in plural locations. An example could be lighting a park and its walkways. The combination fixture of FIG. 2A or FIGS. 2B and 2C provides (a) the reference multi-directional, directly viewable luminance and (b) the directional targeted illumination, for plural locations throughout the park. Less light pollution, lower energy costs, and longer lasting light sources are achieved while retaining the appearance of aesthetically pleasing lighting appropriate or desired for the application.

The color temperature of the light source for each of the luminous and task light sources can be different. For one example, color temperature for the transmissive or luminous surface might be approximately 3000 K in order to provide a visually pleasing ambiance. The color temperature of the task light might be approximately 4000 K for enhanced perception of visual clarity. Other embodiments might use different color temperatures (or colors), depending on the desired effect. Determination of desired color temperatures or colors for the transmissive or luminous surface could be made depending on desired lighting effect, with consideration for the eye's visual response characteristics; for example the luminance of the globe could be in a minimal perception range and the luminance directed to the target area could be in the optimum range for illumination. Installation location and existing lighting could also influence the selection of color temperatures or colors for the light sources.

2. Specific Description of Embodiment 1

The embodiment of FIG. 2A comprises essentially (a) a "globe light" 10 of the general type as seen in FIG. 2A, and (b) a directional light 23 which is not readily visible. The upper globe 10 could be of a type of material commonly called diffuse acrylic lens, or could be made of other translucent, transparent, or diffusive material such as glass or other plastics. In one example, globe 10 can be on the order of 1-2 feet in diameter. Various types of effects such as colorings, fillers (such as light diffusing particles), coatings, or surface textures or shaping could be incorporated to diffuse the light as is well known in the industry. An individual light source, such as an LED 20 (FIG. 2D), that could be on the order of ½-3 watts, would be provided within the base 11/14 for mounting the globe to illuminate the globe. The light source could also be another type of solid-state light source, or could be of a type other than solid state, including but not limited to an incandescent light or a light pipe or fiber optic source from the lower luminaire, as a few other examples. The globe/light source can be configured to provide approximately 0.1 fc luminance, in contrast with typical fixtures that could use a much larger lighting source providing a luminance typically in the range of 50-150 fc.

The first embodiment is constructed as follows (refer to FIGS. 2A, 2D, and 2E). Mounting tube 11 forms a part of the base and support for a globe 10 of translucent material. Collar 14 could be used to provide a stepped mounting surface for globe 10. It could be affixed to mounting tube 11 by standard threads or other means, or retained using plate 16 as described below. A complementary rim extending outwardly around the perimeter of a hole into globe 10 is removably insertable and fixable in collar 14 of the mounting tube 11, using three setscrews 12 (see FIG. 2A) spaced radially 120° apart around the mounting tube to retain the globe. Other means of retaining the globe, which are common in the art, could be used as well. A gasket 13 might be affixed between the globe and the collar.

Figure 2D:
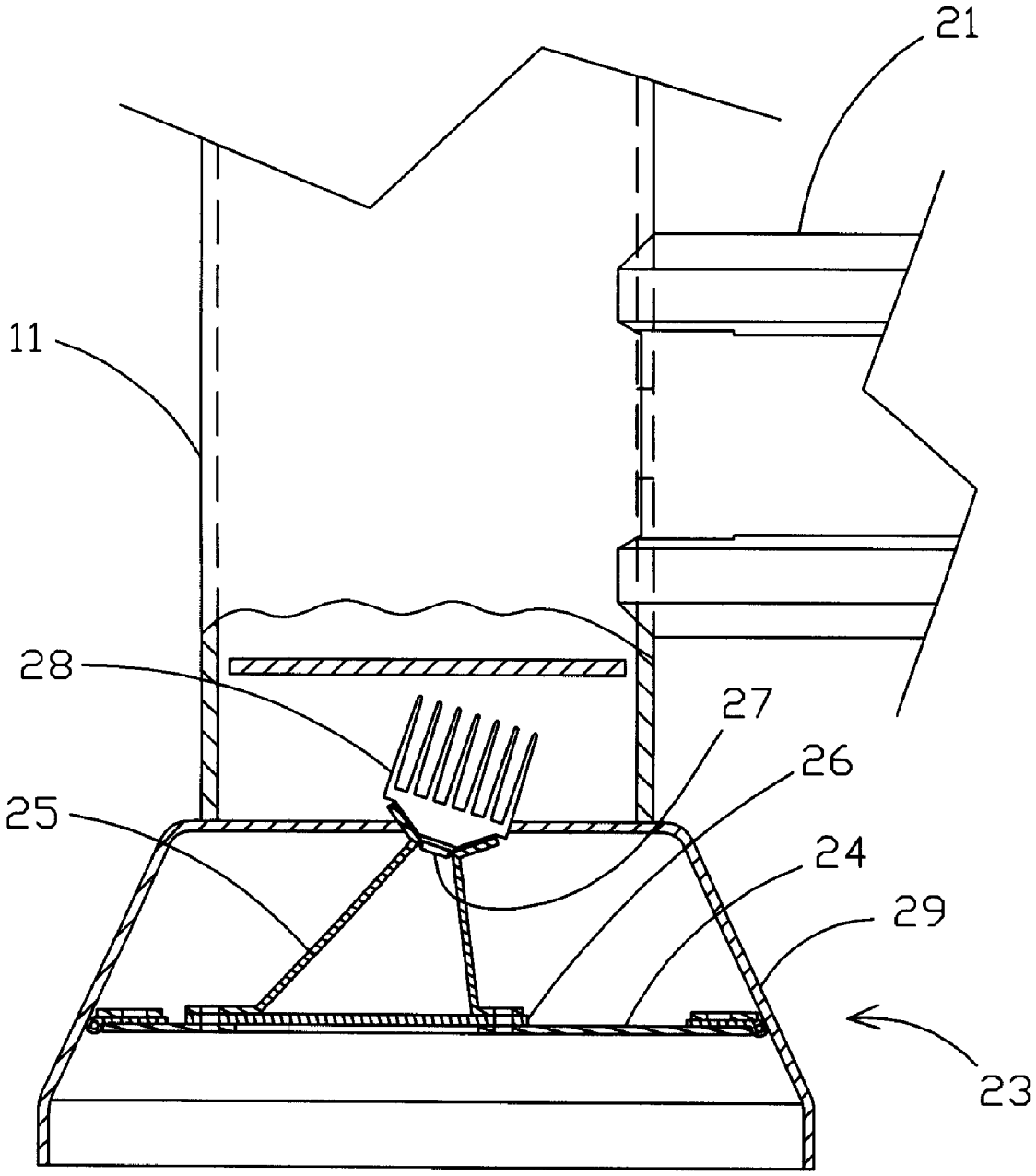
FIG. 2D illustrates details relating to the first embodiment of FIG. 2A.
Figure 2E:
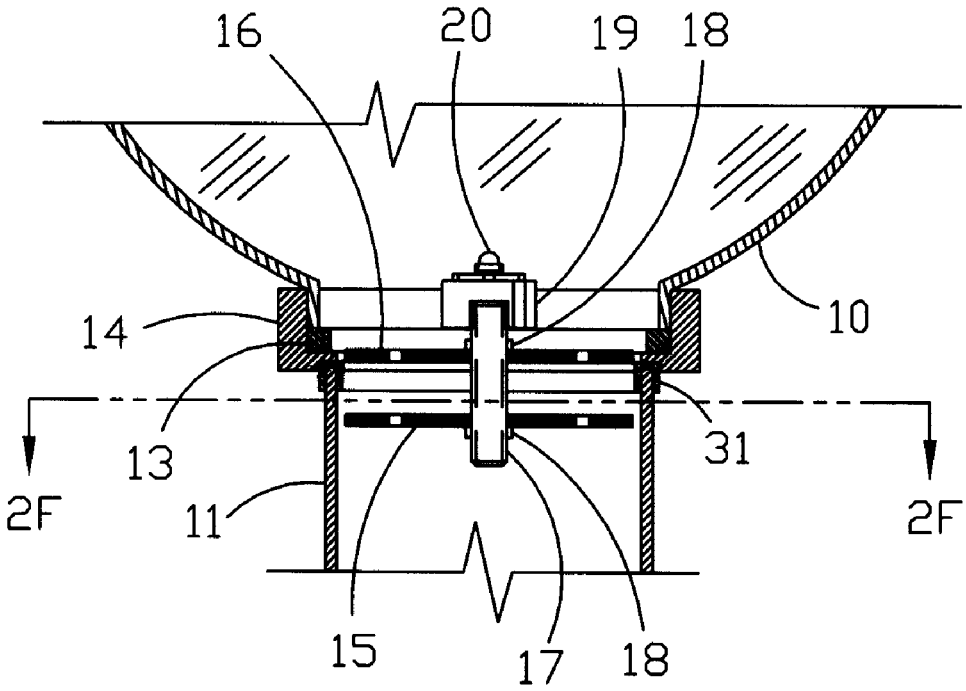
FIG. 2E is a vertical section of the first embodiment which illustrates further details relating to the first embodiment of FIG. 2A.
Figure 2F:
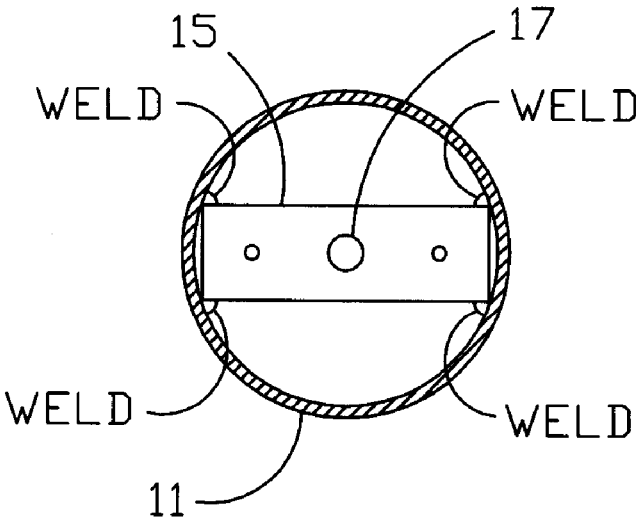
FIG. 2F is a sectional view taken along line 2F-2F of FIG. 2E.

A first elongated rectangular plate 15 is rigidly and permanently affixed by welding at its four corners or other means across or near the upper end of mounting tube 11 (see FIG. 2F). Plate 15 has a center opening through which a threaded stud 17 fits. Plate 16, which is similar or identical to plate 15, is welded at its four corners or otherwise rigidly mounted or manufactured integrally across the inner surface of collar 14 (e.g. in a similar manner as shown for plate 15 in FIG. 2F), and has a center hole for stud 17. Threaded stud 17 is inserted into holes in plates 15 and 16. Rotation of locking nuts 18 in appropriate directions draws plates 15 and 16 together, thereby affixing collar 14 securely to mounting tube 11 (a U-shaped-in-cross-section gasket 31 can be positioned around the upper rim of tube 11). The upper end of threaded stud 17 is thereby securely positioned so as to form a mounting point for the upper light source 20 (see FIG. 2E).

Light mount disc 19 is threaded onto threaded stud 17. Disc 19 has a concentric hole, which is tapped or threaded to receive the upper end of stud 17. Three other smaller holes (not shown) completely penetrate disc 19 allowing a standard LED package to be mounted to the top of disc 19. In this embodiment, an LED 20 of approximately 1-3 watt power rating such as Luxeon Model K2 available from Philips Lumileds Lighting Company, San Jose, Calif. (USA) could be used. LED 20 could be affixed to disc 19 using two holes for screws or fasteners. Thermal grease could be applied in the interface between LED 20 and disc 19. Power leads for the LED could be inserted through the remaining hole in disc 19. In this manner, a conventional-looking translucent globe 10 can be removably mounted easily but securely to the top of a post or pole 14 (FIG. 2A, or 2B and 2C), but use a relatively low light output and low power-consuming, extremely long rated life solid-state light source. It looks like a conventional globe-type light fixture. Mounting tube 11 could be affixed to arm 21 (FIG. 2A). Power driver 22, such as are well-known, could be affixed within arm 21 or at any location convenient to provide power to LED lights. Driver 22 is connected to switched line power, and provides current to drive LED 20 as well as second, lower LED 27, which is further described below. If more than one arm 21 and globe 10 arrangement are mounted on a single pole 14 (see FIGS. 2B and 2C), only one driver need be provided per pole 14.

Affixed beneath mounting tube 11 is shroud 29 (see FIG. 2D). Plate 24 with cutout (covered by lens 26) is attached internally to shroud 29. Conical reflector 25 is affixed above lens 26 onto plate 24. The light source 27 is affixed to the upper end of reflector 25. Heat sink 28 is attached to light source 27. Light source 27 could be an LED such as 3-7 watt LED available from Citizen Electronics Co., Ltd, Tokyo, JAPAN or other solid state light source or other low wattage light source. Driver 22 in arm 21 provides power for light source 27.

Light source 27, and its optic system comprising a reflector 25, produce a quite directional beam of light 271 (see FIG. 2A) to a part of, or a target in, the area to be illuminated (e.g. on the ground surface X). Because the light source 27 is recessed within luminaire 23, as positioned by reflector 25 and the lens/plate 26/24, it is essentially hidden from direct view by observers at or near the area to be illuminated (except perhaps by observers standing quite near or under the light and looking up) (see FIGS. 2B and 2C).

Figure 2G:
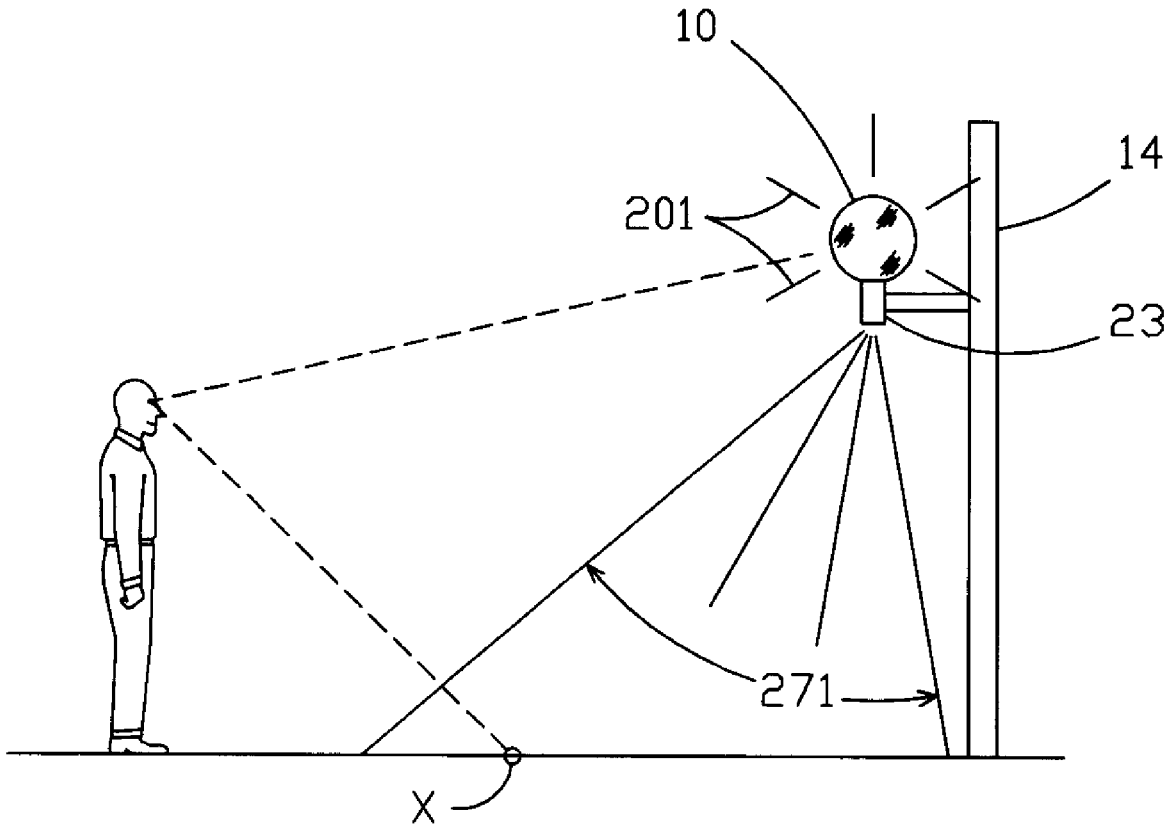
FIG. 2G is an illustration of a relative brightness between a lighting unit like that of FIG. 2A and the ground around it.

The beam could have a circular, elliptical, or other pattern as desired, and would have a minimum emittance angle referenced to vertical of approximately 40° (FIG. 2G). Total light emittance for a such a luminaire could be on the order of 500 lumens.

FIGS. 2B and 2C illustrate a variation where a single elevating structure (pole 14) includes multiple fixtures of FIG. 2A (here four). The four transmissive or luminous surfaces (globes 10A-D) could provide a relatively low level, directly viewable, omni-directional light (giving the appearance they are providing task lighting), but the four fixtures 23A-D could provide the efficacious task lighting as described previously through controlled directional beams 271A-D.

FIG. 2G illustrates the relationship of embodiment 1 to a typical viewer. The viewer would directly view the relatively low luminance of globe 10 but would have good visibility of the task light ground X by task light 23 which is not directly viewable.

Variations from embodiment are, of course, possible. Following are a few examples for illustration:

Embodiments 1a-1c: Embodiment 1 as described above can be configured specifically for conditions that would be common such that for certain design criteria, extensive experimentation is not necessary.

Embodiment 1a—"Park" Version: Globe 10 FIG. 9*a* has luminance not to exceed 0.1 fc, globe mounting height 90=8-10 feet, elliptical pattern of task lighting for lighting walkway, projected pattern of task lighting path lighting having minimum emittance angle 95 referenced to horizontal of approximately 40°, LED illumination of secondary luminaire providing up to 500 lumens.

Embodiment 1b—"Town" Version (suitable for typical conditions in small town "town square" type areas): Globe 10 FIG. 9*a* has luminance not to exceed 1 fc, globe mounting height 90=10-12 feet, elliptical pattern of task lighting for lighting walkway having minimum emittance angle 95 referenced to horizontal of approximately 40°, LED illumination of secondary luminaire providing between 500 and 1000 lumens, two LED sources typically used to provide target illumination.

Embodiment 1c—"Metro" Version (suitable for brighter metro/urban areas): Globe 10 FIG. 9*a* has luminance not to exceed 5 fc, globe mounting height 90=10-12 feet, elliptical pattern of task lighting for lighting walkway having minimum emittance angle 95 referenced to horizontal of approximately 40°, LED illumination of secondary luminaire providing between 1000 and 2000 lumens.

Figure 9B:
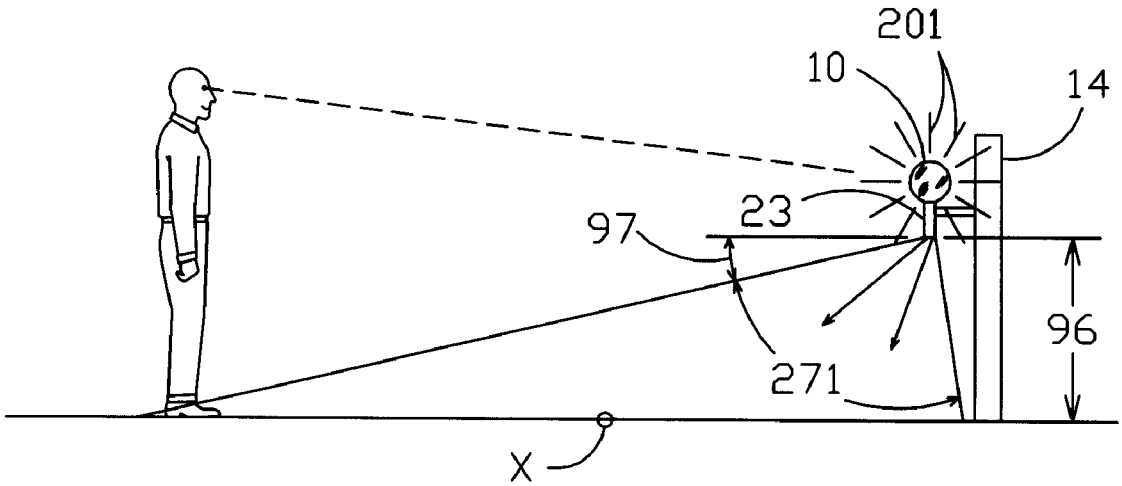
FIG. 9B is an illustration of a relative brightness between a lighting unit like that of FIG. 2A and the ground around it with respect to a different given mounting height.
Figure 2A:
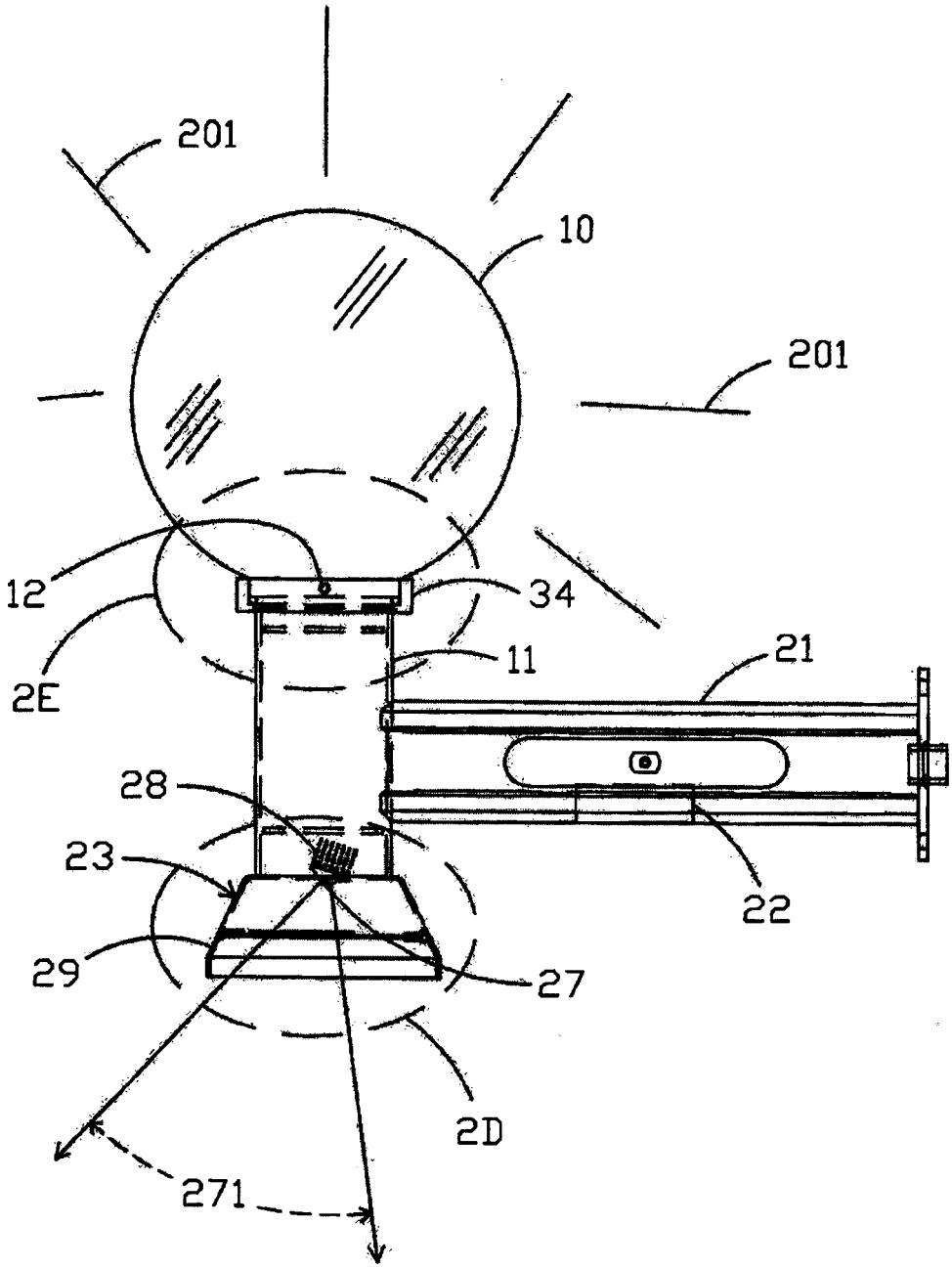
Figure 2E:
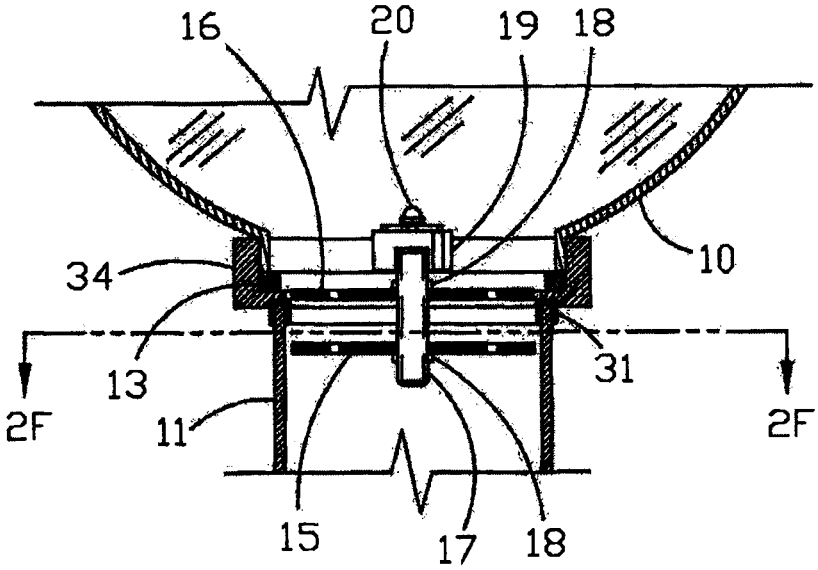
Figure 2F:
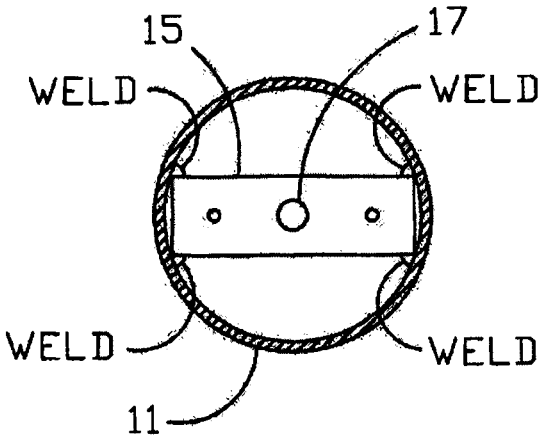

Embodiment 1d: "Park Walkway" version (FIG. 9*b*)—globe or luminous surface not exceeding 0.1 fc, height 96 on the order of 4 feet or less, projected pattern of task lighting for path lighting having minimum emittance angle 97 referenced to horizontal of approximately 5° allowing "long throw" of lighting without glare, LED illumination of secondary luminaire providing between up to on the order of 500 lumens for, e.g., low background light situations (could be higher or even much higher in other contexts, such as brighter background light situations).

F. Exemplary Method and Embodiment 2

Figure 1B:
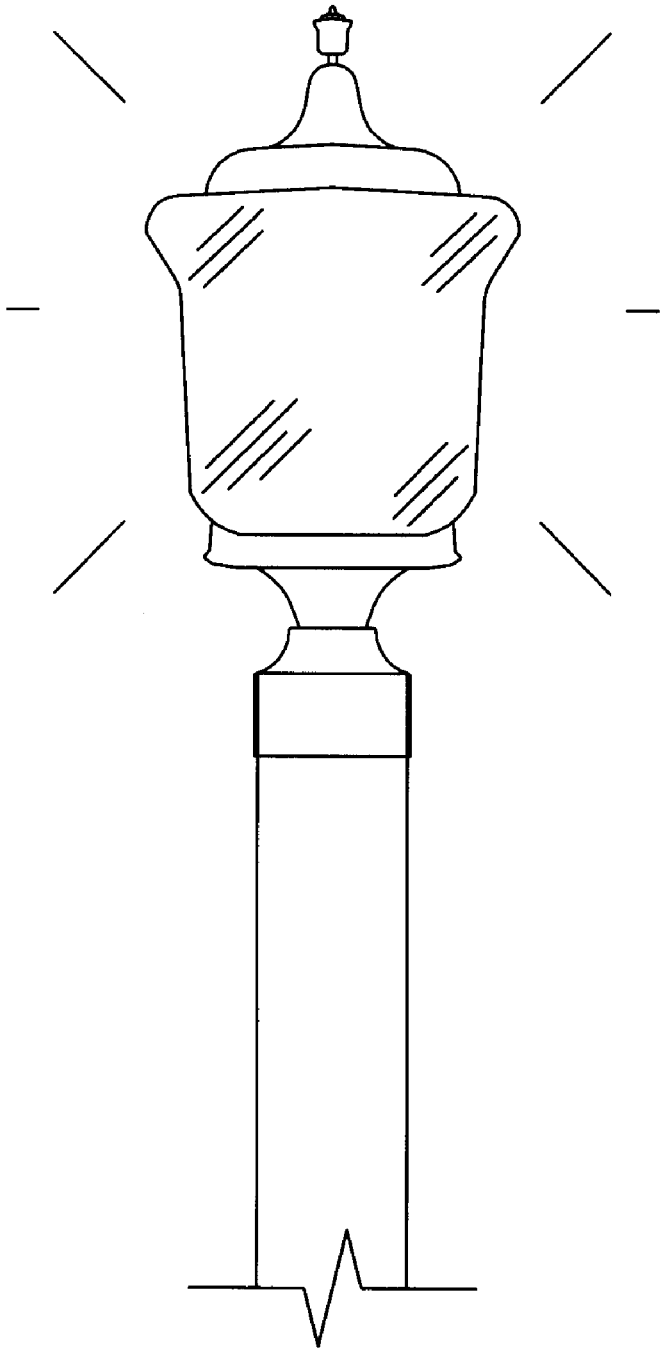
FIG 1B (PRIOR ART)
FIG. 1B illustrates a typical 'acorn' globe type fixture.
Figure 3:
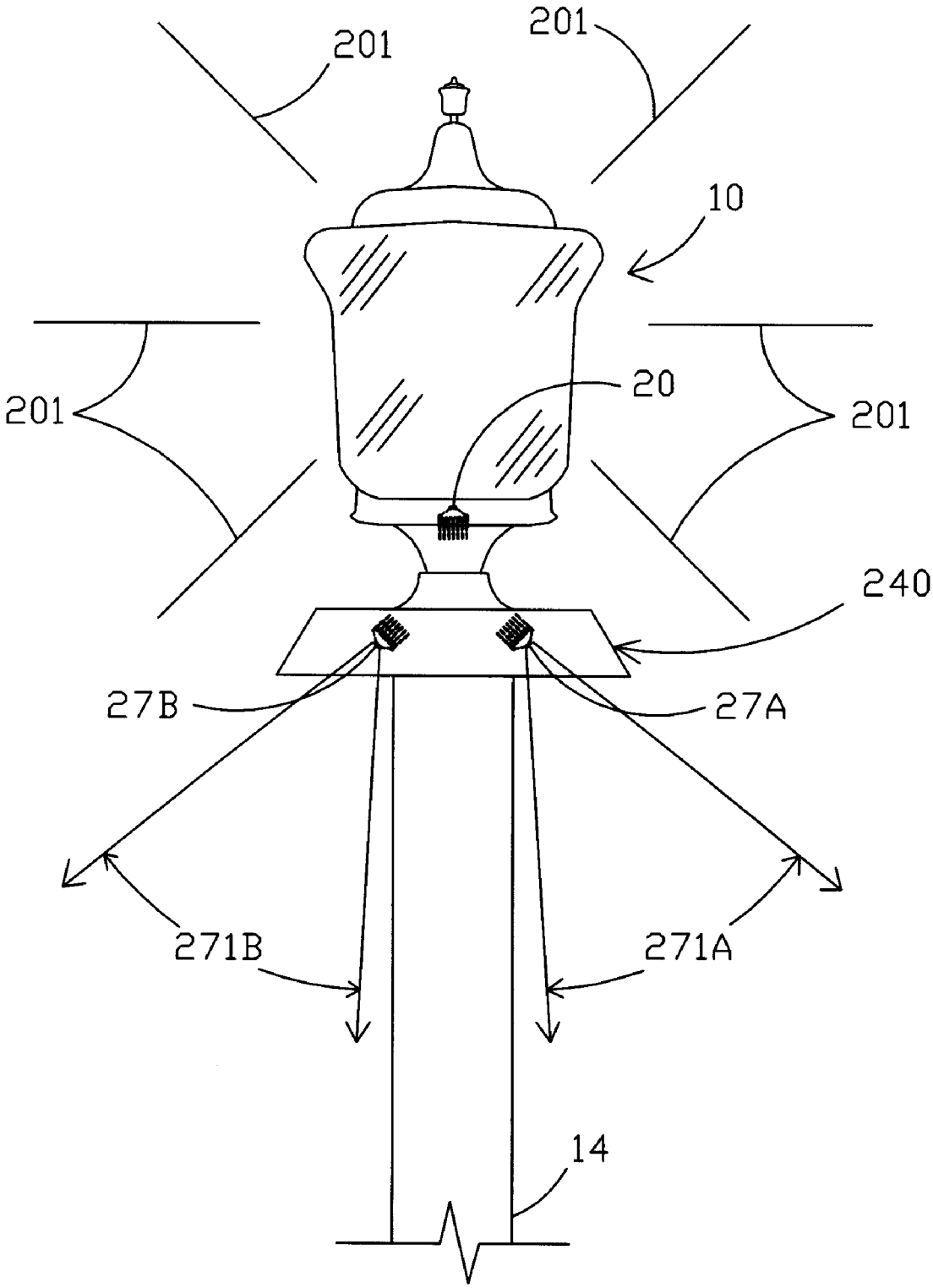
FIG. 3 is a simplified illustration of a second embodiment according to the present invention.

An "acorn light" as seen in historic areas or with retrospective newer designs (refer to FIG. 1B) could be utilized in an Embodiment 2 with the same principle as described in Embodiment 1. A transmissive or luminous surface to provide a glow 201 and reference point (using illumination from light source 20) and a lower non-intrusive luminaire (generally at 240) would provide area or task illumination (see FIG. 3). LED sources 20 and 27A/B and associated heat sinks are shown in dashed lines in FIG. 3 for understanding of their general positions and orientation, but would be hidden from direct view by globe 10 and/or its base or solid opaque collar 240. Because there is no arm supporting the 'acorn' globe 10 (it is mounted on top of post 14), it would require a collar or ring 240 below the globe 10 to provide a light source for area illumination (refer to FIG. 3). The collar could be used to mount several luminaires with light sources such as 27A and 27B or could be used as part of a reflection system to direct light from one or more LEDs or other types of light sources that are within the body of the fixture, in order to produce, for example, directional beams of light 271A and 271B to a part of, or a target in, the area to be illuminated, using a light source that is not directly visible.

G. Exemplary Method and Embodiment 3

Figure 1C:
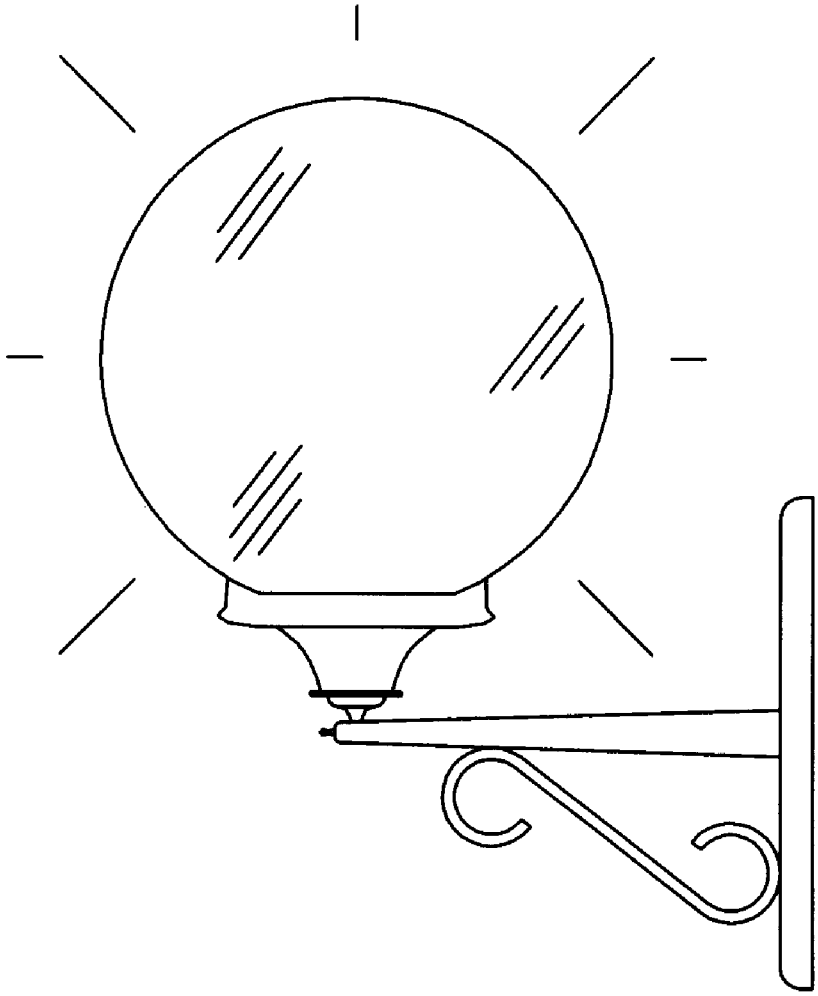
FIG 1C (PRIOR ART)
FIG. 1C illustrates a typical wall-mount globe-type fixture.
Figure 1D:
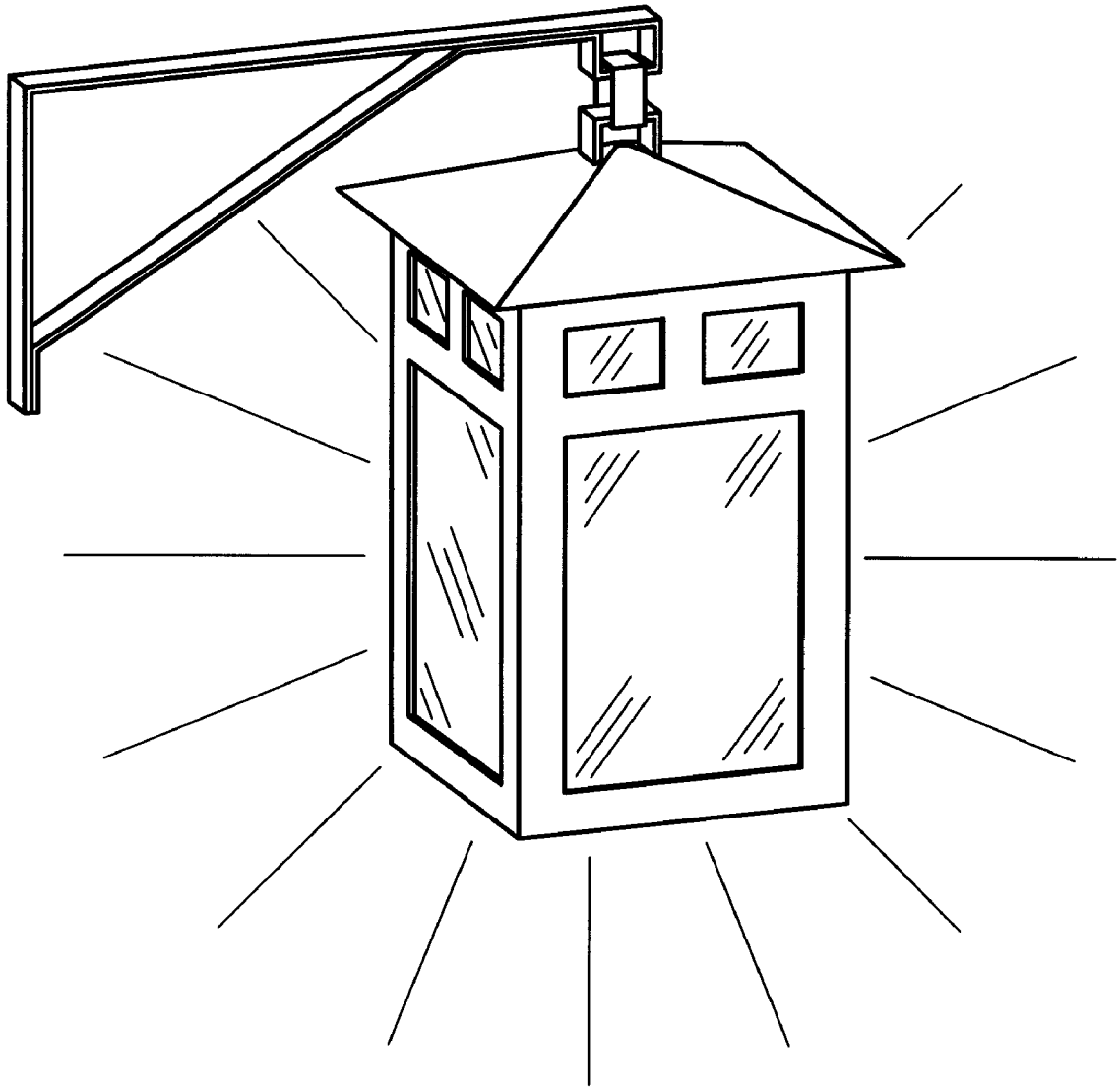
FIG 1D (PRIOR ART)
FIG. 1D illustrates a typical lantern-type fixture.
Figure 4:
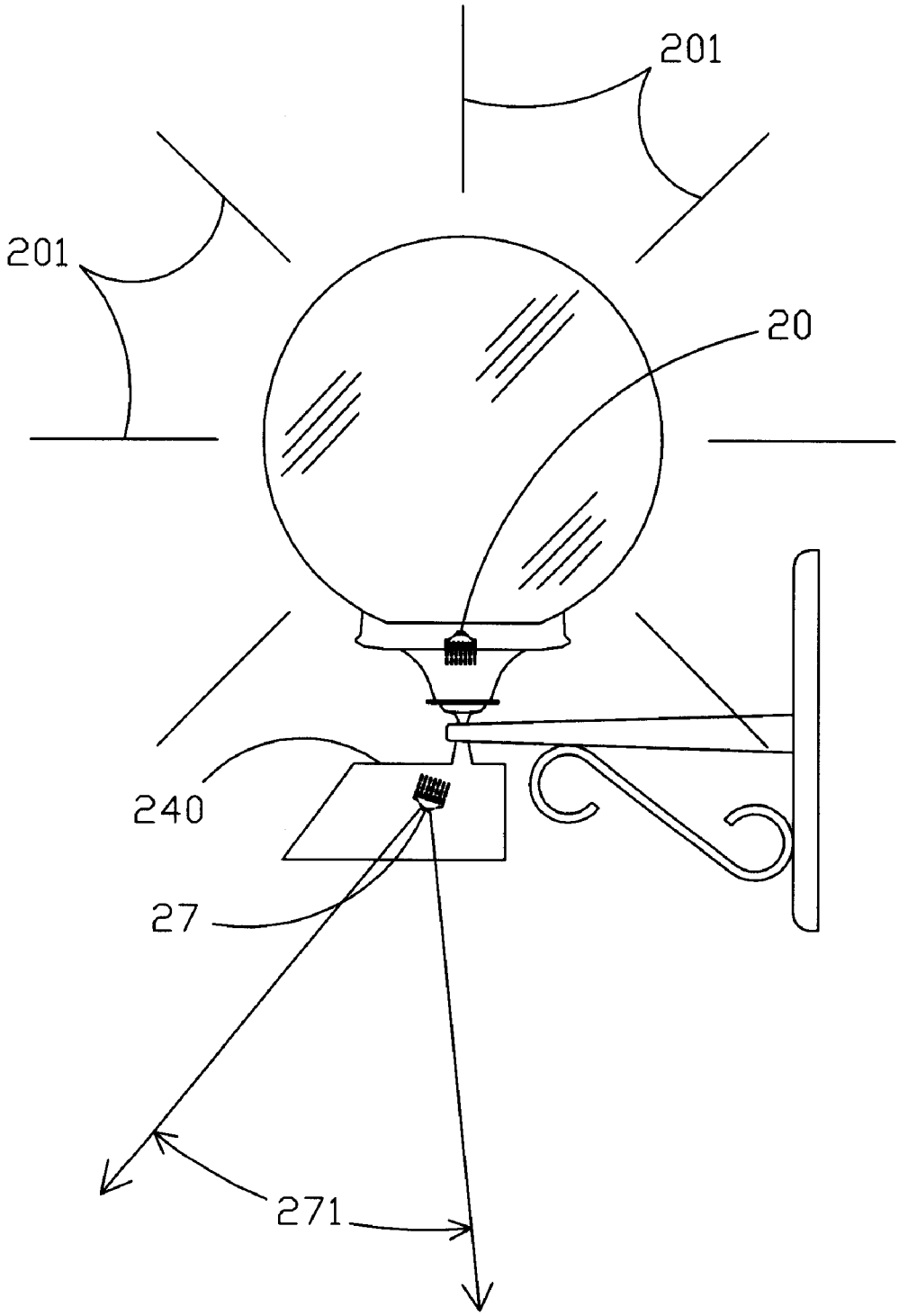
FIG. 4 is a simplified illustration of a third embodiment according to the present invention.

Common 'porch' or wall lantern or globe lights (see FIG. 1C) could be adapted in an Embodiment 3 using this technology. A transmissive or luminous surface to provide a glow and reference point (using illumination from light source 20) and a lower non-intrusive luminaire would provide area illumination (see FIG. 4). The lower light assembly 240 could incorporate a luminaire or luminaires with light source 27 and other means in order to produce for example a directional beams of light 271 to a part of, or a target in, the area to be illuminated, using a light source that is not directly visible.

This embodiment could also be modified in order to provide targeted illumination of building surfaces (e.g. "washing") for aesthetic illumination of building features without over illumination or glare. Again, sources 20 and 27 are shown in dashed lines for clearer illustration of position and orientation, but would be hidden from direct view.

H. Exemplary Method and Embodiment 4

Figure 1E:
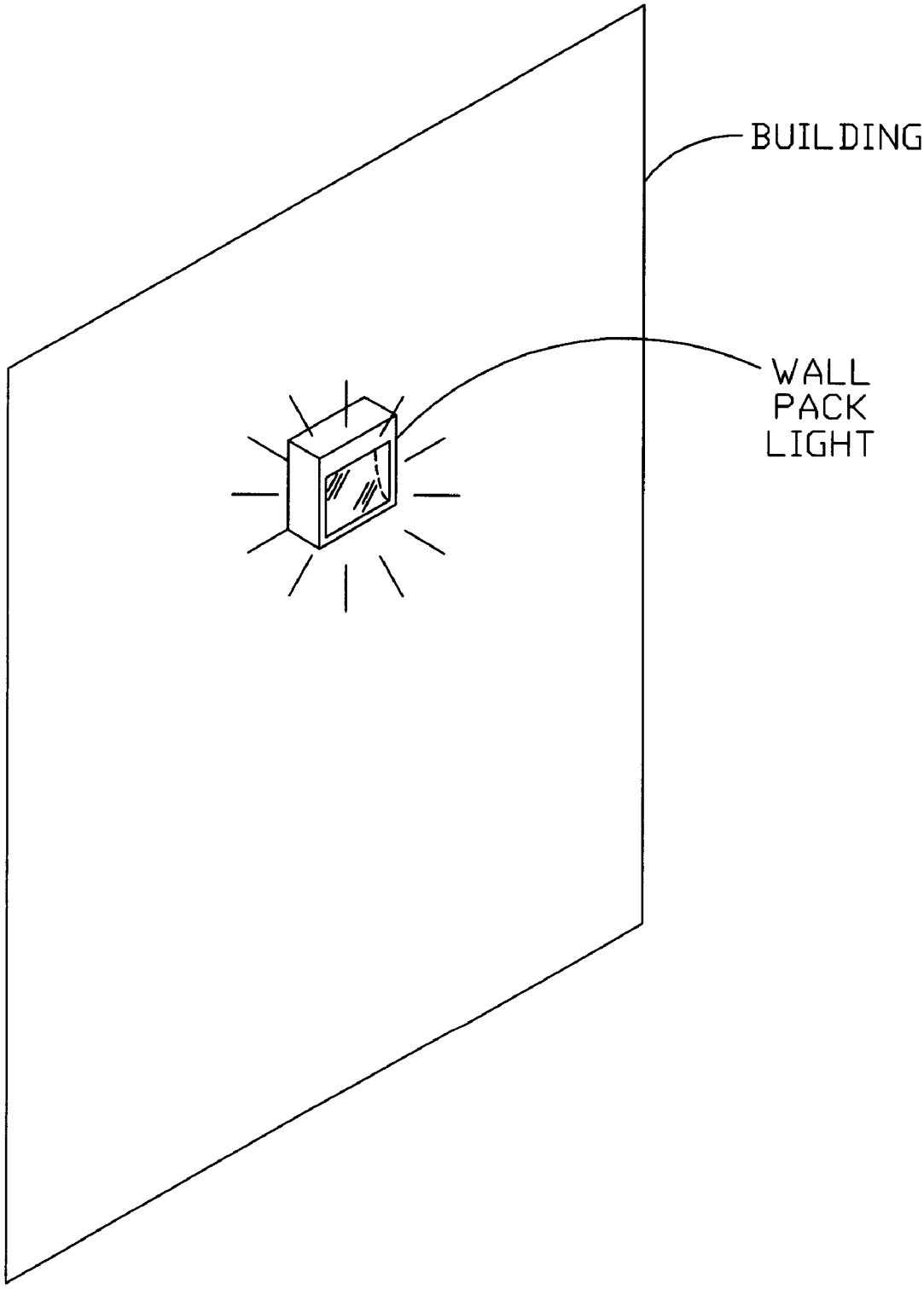
FIG 1E (PRIOR ART)
FIG. 1E illustrates a typical wall pack type fixture.
Figure 1F:
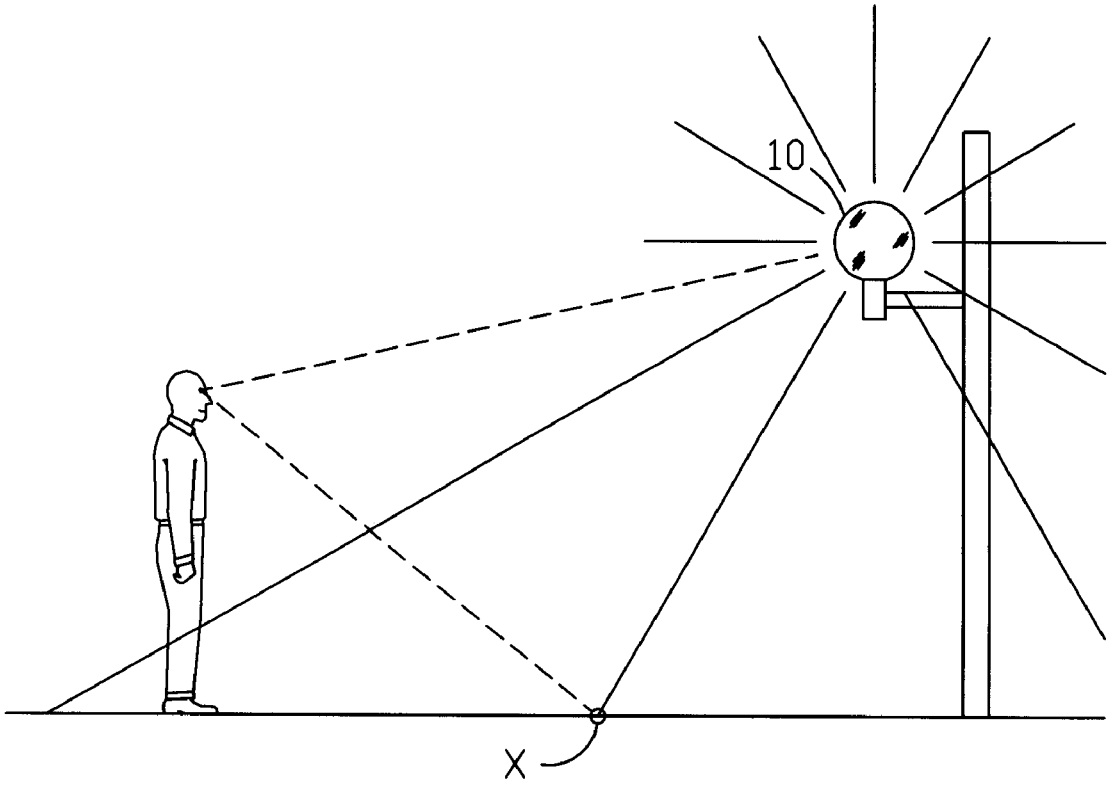
FIG 1F (PRIOR ART)
FIG. 1F is a simplified illustration of relative brightness between a globe type fixture such as FIGS. 1A and 1C and the ground near it.
Figure 1G:
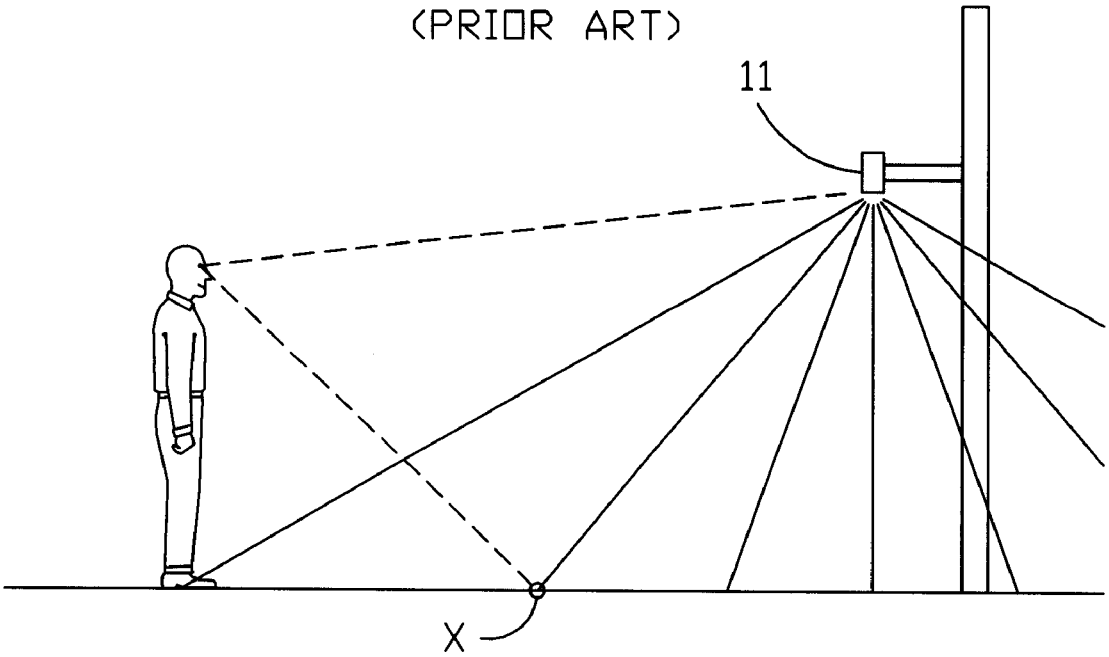
FIG 1G (PRIOR ART)
FIG. 1G is a simplified illustration of relative brightness between a directional task light and the ground near it.
Figure 5:
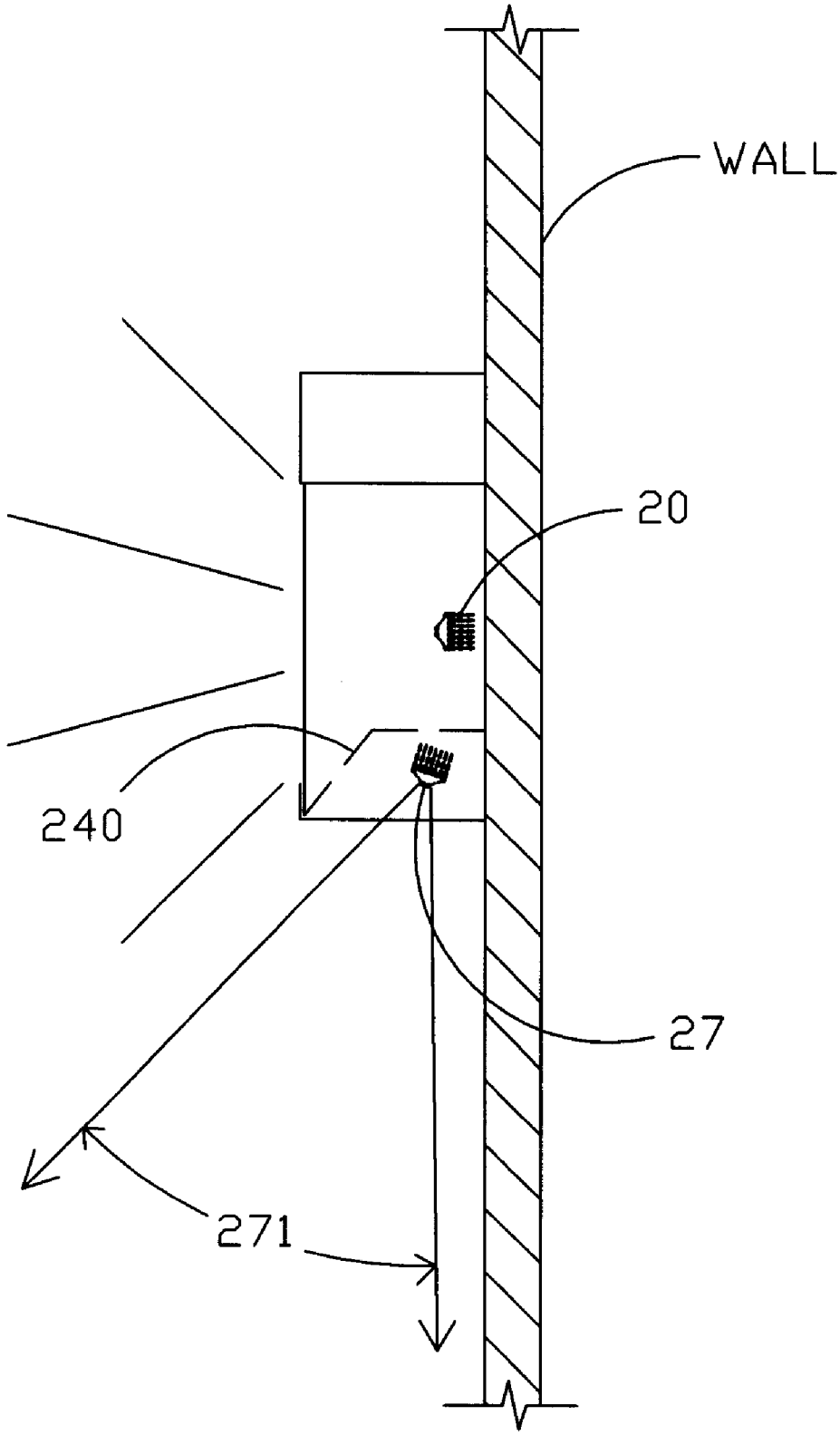
FIG. 5 is a simplified illustration of a fourth embodiment according to the present invention.

A "wall pack" type fixture (see FIG. 5), commonly used for building wall or facade lighting, could be adapted in an Embodiment 4 using this technology. This type of fixture is typically surface mounted to the structure and provides lighting on the wall in the near vicinity of the fixture or provides area lighting near the structure. A difference from the conventional wall pack fixture shown in FIG. 1E is a transmissive or luminous surface (e.g. first lens, reflector or source 20) to provide a glow and reference point (using illumination from light source 20) and a lower non-intrusive luminaire with light source 27 would provide target illumination (see FIG. 5). The lower light assembly 240 could incorporate a single luminaire or several, each with light source(s) 27 and other means in order to produce, for example, a directional beam of light 271 to a part of, or a target in, the area to be illuminated, using a light source(s) that is not directly visible. This embodiment would provide targeted illumination of building surfaces (e.g. "washing") for aesthetic illumination of building features without over illumination or glare. It could also be designed to provide targeted illumination of a pathway or surface near the building. Like the indicator lights or guide lights to designate a pathway, a wall light of Embodiment 4 could also serve as a reference for the building or some particular feature of the building (e.g. the entry door). By minimizing the luminance of the primary source 20 (transmissive or luminous surface), the task lighting can be more effective in highlighting the desired features of the illuminated area and the surroundings. Sources 20 and 27 are shown in dashed lines to illustrate position and orientation inside the fixture but would not (especially source 27) be directly viewable from most viewing orientations.

Alternatively, the wall next to the fixture could be illuminated and produce a luminous surface which functions like the transmissive or luminous surface of a globe or panel on the fixture.

I. Exemplary Method and Embodiment 5

Figure 6:
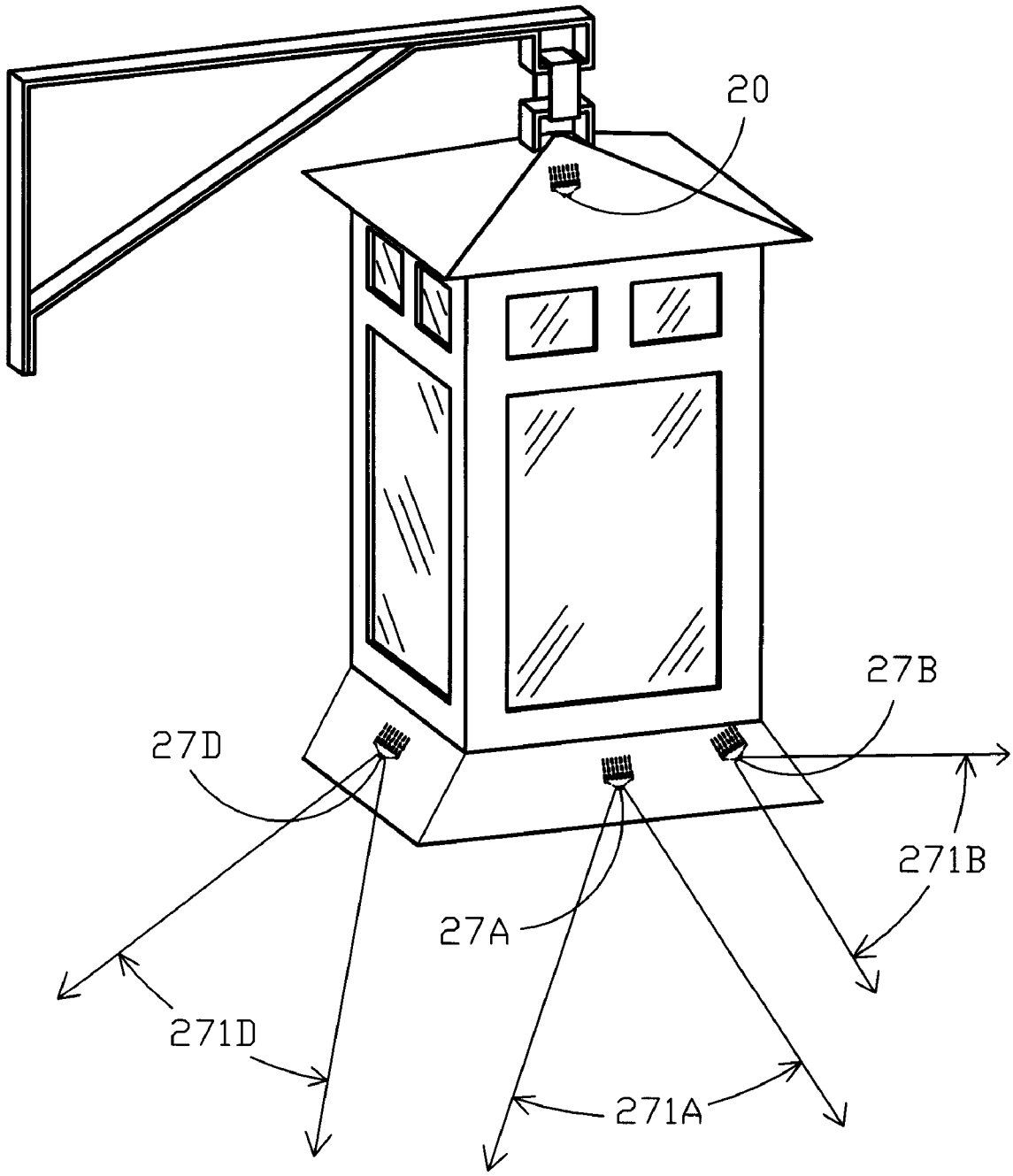
FIG. 6 is a simplified illustration of a fifth embodiment according to the present invention.

Lantern style lamps (refer to FIG. 6) could be designed in an Embodiment 5 using this technology. A transmissive or luminous surface (e.g. translucent panes in openings in lantern housing) to provide a glow and reference point (using illumination from light source 20) and a lower non-intrusive luminaire with light source 27 would provide area illumination. The lower light assembly could incorporate luminaires with light sources such as 27A, 27B, and 27D (See FIG. 6) and/or other means in order to produce, for example, directional beams of light 271A, 271B, and 271D to a part of, or a target in, the area to be illuminated, using a light source that is not directly visible. Like FIGS. 3-5, sources 20 and 27A, B, and D are shown in dashed lines because they would be hidden from this view.

J. Exemplary Method and Embodiment 6

Figure 7:
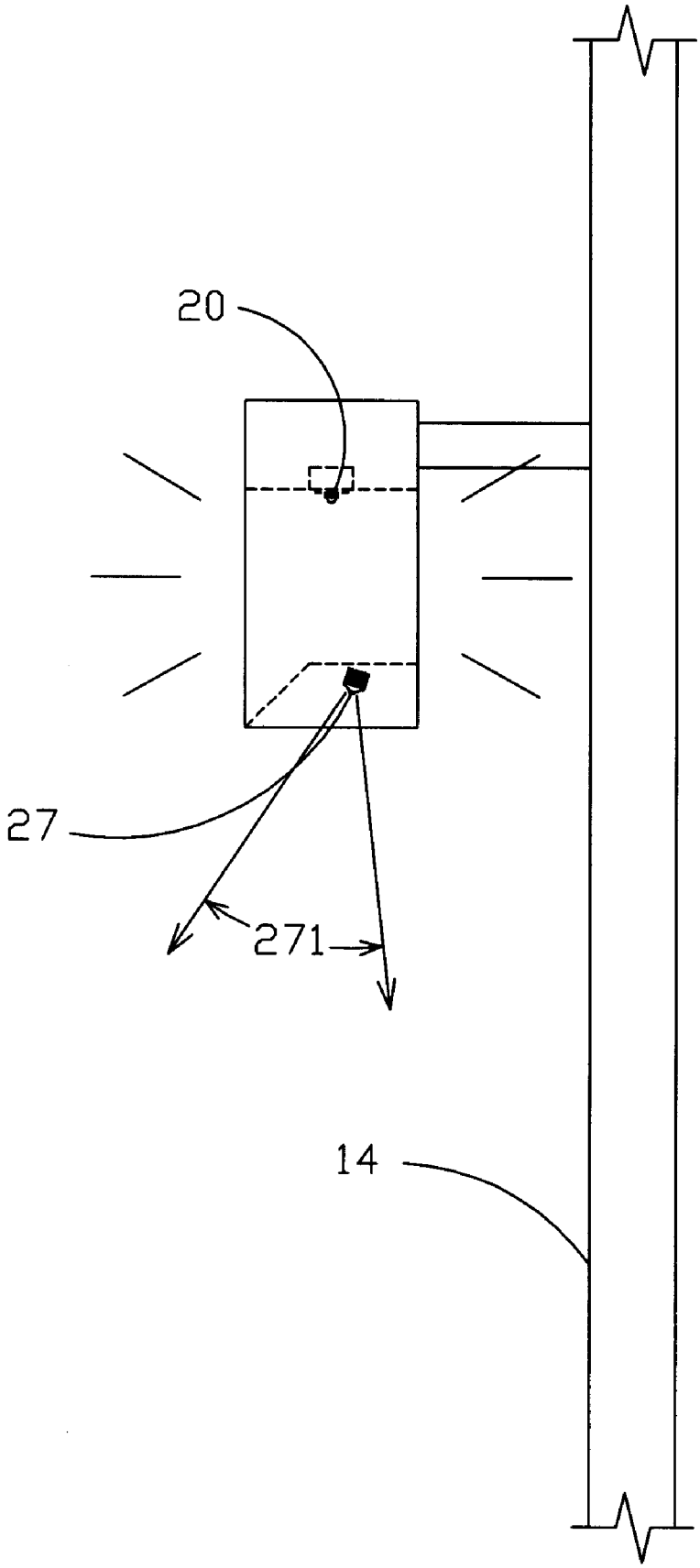
FIG. 7 is a simplified illustration of a sixth embodiment according to the present invention.

Similar to Embodiments 3 and 5, a 'jelly jar' type (see FIG. 7) could be adapted in an Embodiment 6 using this technology and elevated, e.g., on a pole or structure 14. A transmissive or luminous surface to provide a glow and reference point as well as to provide illumination and indication of an entry way or door (using illumination from light source 20) and a lower non-intrusive luminaire with light source 27 would provide area illumination such as for a walkway, etc. The lower light assembly could incorporate a single luminaire or several, each with light source(s) 27 and other means in order to produce, for example, directional beams of light 271 to a part of, or a target in, the area to be illuminated, using a light source that is not directly visible. This embodiment could also be modified in order to provide targeted illumination of building surfaces (e.g. "washing") for aesthetic illumination of building features without over illumination or glare.

K. Exemplary Method and Embodiment 7

The envisioned invention could be adapted to retrofit existing light fixtures with the general concept of the exemplary embodiments. This could be done by designing interior components to cause a globe, lantern, acorn or other transmissive or luminous surface to glow and by providing a task light that can produce directional beams of light to a part of, or a target in, the area to be illuminated, using a light source that is not directly visible from most normal viewing angles. Another means of retrofitting lights could use existing poles or structures on which new arms and fixtures, designed according to the principles of the present invention, could be fitted.

L. Exemplary Method and Embodiments 8 and 9

The envisioned invention of embodiment 8 could alternatively use either a single light source 20, or multiple light sources 27A/B (e.g. FIG. 8A) within the same globe or fixture, wherein most of the light is controlled by optical apparatus to provide task lighting while remaining essentially invisible to the normal observer. This could be done by designing interior components to cause a globe, lantern, acorn or other transmissive or luminous surface to glow and by providing a task light that can produce directional beams of light to a part of, or a target in, the area to be illuminated, using a light source that is contained within the globe or fixture. Lighting source(s) 20 and/or 27 have been included with the globe or 'acorn.' Reference lighting within the globe can be produced which is of a translucent material. Convex mirrored surface 28 (FIG. 8A) is typical of an optical component that may be used to help diffuse light from source 20 or potentially from the source(s) 27 of task lighting. By designing the position, orientation and associated structure accordingly, both the reference luminance and task lighting are achieved in one globe.

Figure 8A:
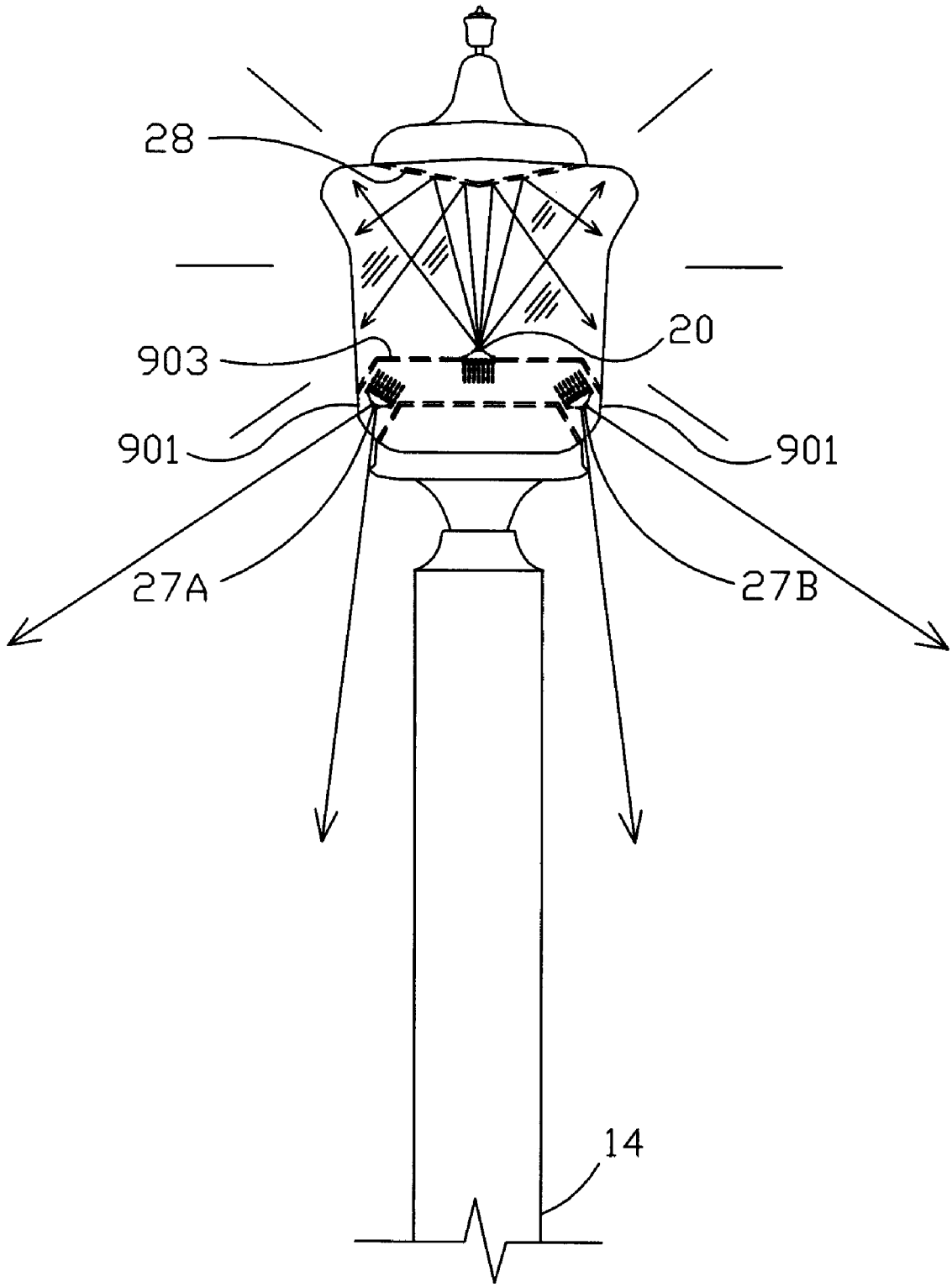
FIG. 8A is an illustration of an eighth embodiment according to the present invention, wherein the source of task illumination is contained generally within the globe or luminous member.
Figure 8B:
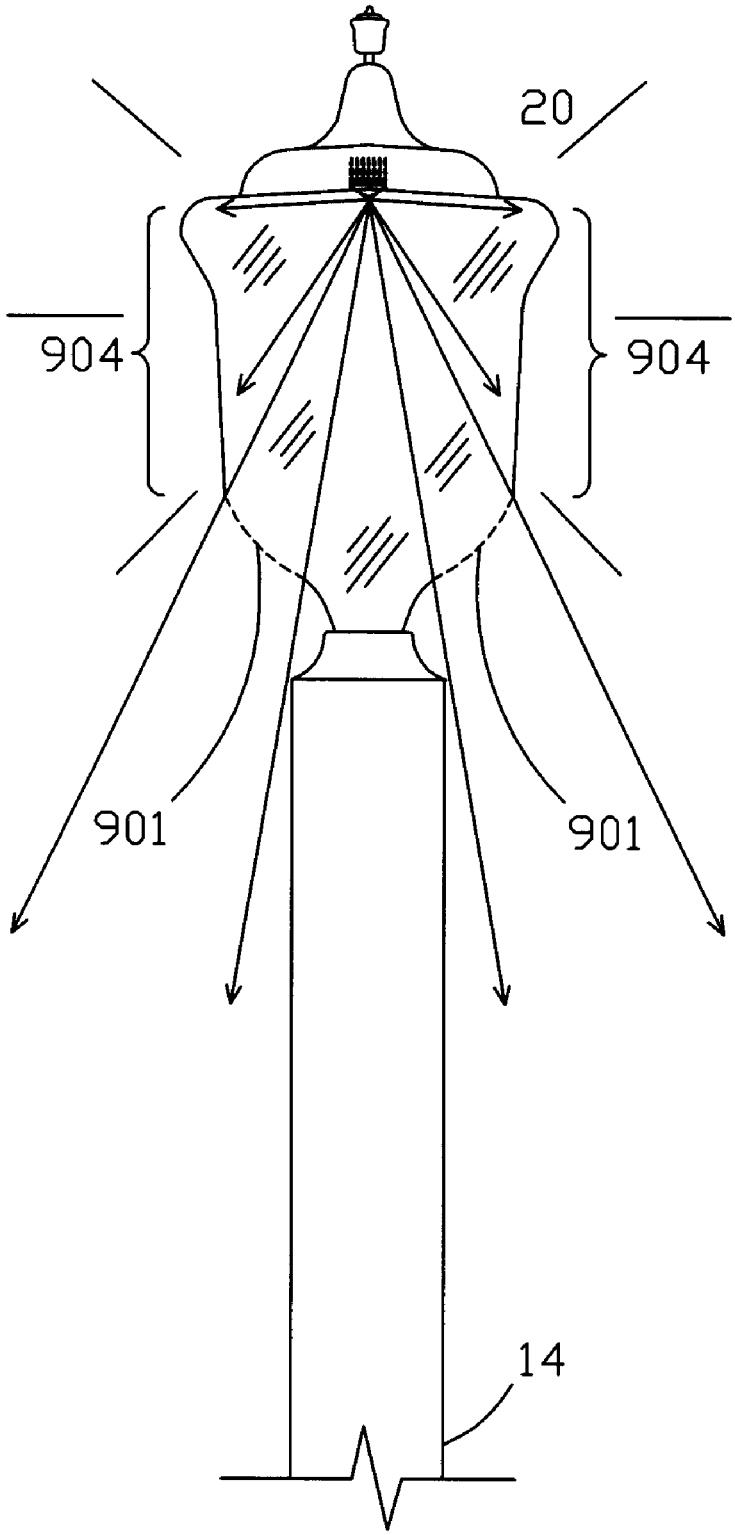
FIG. 8B is an illustration of a ninth embodiment where one light source provides light for both creating a luminous surface and task or directional lighting.

In embodiment 9, as indicated in FIG. 8B and the above description relative to embodiment 8, this aspect of the invention can be practiced with even a single light source 20 (e.g. solid state, incandescent, HID, etc.) in a configuration that produces both the reference luminance as well as a directional or task lighting. The essentially analogous principles to those involved with the other described embodiments would be followed. In other words, the invention can take the aspect of using literally a single light source such as one LED or one incandescent lamp or bulb and use some of its lumen output to produce reference luminance and some of its lumen output to produce directional or task lighting from one translucent globe.

One example could be an LED light source having somewhat directional light output pattern. Some of the light output pattern could be captured or directed or reflected in a manner that could produce a relatively low level, non-directional luminance to function as a reference luminance according to the principles of this invention. Other portions of the light pattern could be allowed to directly pass, in a directional fashion (or could be directed or reflected in a directional manner) for directional and/or task lighting function, of the type described earlier in this application. The lighting designer would have a variety of options to do so including any variety of optics, reflectors, and associated ability to optionally diffuse light or not for these different functions from the same single light source.

In the example of FIG. 8A, embodiment 8, a plurality of individual light sources (e.g. individual LED die or individual incandescent or HID lamp) are used and partition light from the plurality of individual sources in a similar manner (some for reference luminance, some for directional lighting). Three LED individual sources 20, 27A and 27B could be contained in a single frosted glass globe. By optical methods, some of the generated lumen output could be used for reference luminance of the globe and some could be used for directional or task lighting. In the particular example of FIG. 8A, one LED 20 generates a somewhat directional output pattern to an optical member such as a convex mirror or reflector 28. By known optical design, the beam pattern and the convex reflector can be designed and configured to disperse or diffuse the beam so that it spreads substantially around the interior of the frosted globe. The amount of light, even dispersed or diffused, would produce a reference luminance from a relatively low lumen output from a single LED.

In the example of FIG. 8B, embodiment 9, a single light source is positioned inside a glass globe having most of the globe either frosted or coated to be translucent (see portions indicated at reference numeral 904). Some light from the single source would be allowed to illuminate the inside of the frosted part of the globe and create a relatively low level of luminance to external observers of the globe. That low level of luminance can be the reference luminance. The designer can use optical techniques to essentially partition some of the light from the single source for a given level of reference luminance. In the same vein, the designer can take all or other portions of the lumen output from the single source and, in directional fashion, create directional lighting or multiple directional lighting out of transparent, non-translucent globe portions 901. In this manner a single source can accomplish both.

On the other hand, one or more other individual light sources (FIG. 8A shows two separate LEDs 27A and 27B) could each be configured to generate a beam pattern for directional or task lighting. One way to produce it would be to use some optical components such as a reflector 903 that would try to help control, concentrate, or directionalize the light energy from one or more of LEDs 27A and 27B for directional or task lighting and/or non-frosted areas of the globe 901 matching approximately the beam shape from LEDs 27A and 27B to pass substantially directional light out of the globe for directional or task lighting. An alternative would simply be a globe that is frosted and presents a surface area for reference luminance from LED 20 and convex mirror 28 with an open bottom allowing directional beams from LEDs 27A and 27B for task lighting. Still further there could be holes or apertures in the globe to allow the task lighting through.

But alternatively, instead of using separate individual light sources for reference luminance and task lighting, a plural number of individual light sources could generate a composite lumen output that could be partitioned, some for reference luminance and some for directional lighting by using optical methods.

These and other options, features, alternatives, aspects, or functions such as might be obvious to those skilled in the art are possible and included within the invention.

What is claimed is:

1. A lighting system comprising:

a. a supporting structure or fixture adapted for placement at a lighting location;

b. a first light source creating a visible but relatively low level of luminance; and c. a second light source or sources and an optic system or systems adapted to provide directed task light at or around the lighting location;

d. so that the luminance related to the first light source provides a perceived but relatively low level to observers, and luminance related to the second light source(s) provides directed and relatively low level of illumination on a target area, together presenting a traditional-looking light source but allowing much less light to be used for effective illumination of the target area while deterring glare, up-light and spill light.

2. The lighting system of claim 1 wherein the first light source comprises a translucent, prismatic, or diffusing member associated with a globe of spherical, acorn, or other shape or a flat pane or panel in a lantern-type fixture.

3. The lighting system of claim 1 wherein the source for at least one of the first and second light sources comprises a relatively low power light source.

4. The lighting system of claim 3 wherein the first light source comprises less wattage than the second light source, but both comprise substantially less wattage than a conventional light source such as incandescent or HID lighting.

5. The lighting system of claim 1 wherein at least one of the first and second light sources could comprise a solid-state light source such as an LED.

6. The lighting system of claim 1 wherein the second light source and optic system provide essentially no light above approximately 60 degrees from nadir to provide a light pattern which comprises a smaller angle from nadir than a full cut off (90 degree from nadir) light pattern.

7. The lighting system of claim 2 wherein the second light source and optic system are contained or mostly contained within volume of space at or near the globe.

8. The lighting system of claim 7 wherein the second light source and optic system provide substantially directional light.

9. The lighting system of claim 7 wherein the second light source and optic system shield direct view of the second light source from substantially all typical observer positions other than looking up from near or directly underneath the second light source.

10. The lighting system of claim 7 wherein the second light source has an equal or lesser emittance angle relative to horizontal as compared to a typical angle of viewing above horizontal.

11. The lighting system of claim 1 wherein the supporting structure comprises a frame or bracket adapted to mount to a post, pole, wall, or other elevating structure.

12. The lighting system of claim 1 wherein the relatively low level of luminance related to the first light source is created by transmission of light from the first light through a low intensity frosted bulb, filament, glowing panel or tube, or other non-point light source.

13. The lighting system of claim 1 wherein the relatively low level of luminance related to the first light source is created by reflecting light from the light source of a nearby surface such a portion of the fixture or a building wall surface.

14. The lighting system of claim 1 wherein reference luminance comprises light reflected by a surface of the fixture or a nearby surface.

15. A method of lighting an outdoors area comprising:

a. generating a relatively low level, multi-directional reference luminance directly viewable by observers at and around the area;

b. illuminating one or more specific targets at the area with directional lighting comprising a full cutoff optic system that is shielded from direct view by most observers in defined viewing areas;

c. wherein the reference luminance is an effective amount to condition observers' eyes to a low level of luminance and produce the appearance that it is causing illumination of the area, but is small enough that it does not contribute significantly to sky glow, glare, or spill light; nor to relative bright adaptation of the viewing eye when compared to the luminance from the area intended to be observed provided by the illumination from the directional lighting; and the luminance from the target area provided by the directional lighting is an effective amount to provide observers with visual recognition of the targets, but low enough and directional enough that it does not contribute significantly to sky glow, glare, or spill light.

16. The method of claim 15 wherein the reference luminance comprises illumination of at least one of a translucent, prismatic, or diffusing member by a relatively low power light source.

17. The method of claim 1 wherein the relatively low level, multidirectional reference luminance, which is intended to be viewed, comprises a historically, architecturally, or aesthetically significant light fixture.

18. The method of claim 15 further wherein the illumination providing the reference luminance and illumination providing the target luminance consume less energy because the reference luminance is sufficiently low that the adaptation level of the observers' eyes allows a reduced light level to effectively light the target area.

19. The method of claim 15 wherein at least one of the reference luminance and the target illumination is created by light from a solid state light source for improved lumen maintenance and light source life than other sources.

20. The method of claim 15 wherein the effective amount of reference luminance and target illumination is selected based on one or more of:

a. overall desired light level;

b. acceptable amount of glare; and c. aiming angle of the illumination.

21. The method of claim 15 wherein the reference luminance and target luminance are of similar intensity levels.

22. The method of claim 15 wherein the reference luminance is generated from a light source of a relatively low power which is below the normal intensity threshold for eye adaptation relative to the luminance from the target area of this claim, and the luminance from the target area is generated by one or more light sources of relatively low power.

23. The method of claim 15 wherein the luminance is generated in a physical location above the lighting sources producing the illumination on the target area.

24. The method of claim 15 wherein reference luminance and target area illumination lighting sources are derived from a single light source.

25. The lighting system of claim 15 wherein the reference luminance comprises illumination a non-point light source such as a low intensity frosted bulb, filament, glowing panel or tube, or other non-point light source.

26. A method of lighting an area comprising:

a. creating luminance which can be directly viewed by observers at and around the area; said luminance comprising a reference level of light to condition the observers' eyes to a low level of light wherein the light source creating the luminance is relatively low power;

b. creating illumination of targets in the area with one or more light sources that are relatively low power in comparison with existing art and directive optic systems to block the light sources from direct view by the eyes of observers in defined areas of observation, but provide a designated amount of illumination to the targets that may be, but is not limited to being, relatively low in comparison to existing fixtures;

c. wherein the low power light source for creating luminance by way of a luminous surface/transmissive surface/visible lamp is selected to minimize or decrease energy usage, sky glow, glare, or spill light relative to conventional fixtures as well as to condition observers' eyes, and the low power light source and directive optic system for illumination of targets is selected to minimize energy usage, sky glow, glare, or spill light.

27. The method of claim 26 wherein at least one of translucent, transparent, prismatic, or diffusing material comprises, a part of a lighting fixture, which simulates a historical, architectural, or aesthetic fixture, or is a part of a wall or other surface that is adjacent or nearby the lighting fixture.

28. The method of claim 26 wherein the luminance is created by illuminating a translucent, prismatic, or diffusing material.

29. The method of claim 26 wherein the non-point source luminance is created by a frosted bulb, filament, glowing panel or tube, or other non-point light source.

30. A method of providing aesthetic area lighting with less sky glow, glare and spill light comprising:

a. positioning a plurality of aesthetically-selected lighting fixtures at spaced-apart locations around the area to be lighted;

b. illuminating in each lighting fixture a directly viewable first light source with a relatively low power to provide a low level reference level of light for observers at or near the area;

c. illuminating predetermined targets within the area with light sources that are not directly viewable by the eyes of observers in defined areas of observation in or around the area;

d. so that i. the lighting is aesthetically pleasing;

ii. the low reference level of light allows 1. a lower amount of light to adequately illuminate the targets;

2. less sky glow;

3. less glare; and/or 4. less spill light.

31. The method of claim 30 wherein the first light source is created by illuminating a translucent, prismatic, or diffusing material.

32. The method of claim 30 wherein the first light source is created by a frosted bulb, filament, glowing panel or tube, or other non-point light source.

33. A method of lighting an area comprising:

a. placing a plurality of aesthetic, historical, or architectural fixtures around the area;

b. each fixture;

i. producing a relatively low, multi-directional reference luminance directly viewable by persons in and around the area and which does not produce human visual photo-responsive adaptation to persons in or around the area ii. producing a relatively low, directional task lighting illumination which creates luminance from the target area, and which illumination is not directly viewable from most viewing angles by the persons in or around the area;

iii. so that 1. the fixtures provide both daytime or night-time visual guidance/demarcation of the area, and 2. the reference luminance provides ancillary illumination of the area at levels that accommodate dark sky regulations;

iv. the ratio of multi-directional luminance to luminance from the target area, perceived by most persons at or near the area deters triggering of visual photo-responsive adaptation response of the eyes of the persons such that the target area is obscured relative to the reference luminance.

34. A lighting fixture having the characteristics of the lighting of claim 33.

35. A method of lighting an area comprising:

a. providing directly viewable surface luminance:

b. providing directional, non-directly viewable task lighting illumination which produces viewable reflected task luminance;

c. the ratio between the highest luminance of the directly viewable luminance and the lowest luminance from the task illumination being within the adaptivity range of the human eye for the particular lighting application and environment, wherein the ratio as measured in lux is on the order of 20:1 or 10:1 for lower light or nighttime conditions and on the order of 6:1 or 5:1 for very low light conditions approaching lowest level of eye sensitivity.

36. The method of claim 35 further comprising selecting color temperatures of the light sources producing the directly viewable luminance and the reflected task luminance to be different.

37. A method of lighting comprising:

a. creating primary reference luminance and secondary luminance from a target area characterized by;

b. an effective scene brightness ratio between the secondary luminance and primary luminance which is less than the typical scene adaptive range of a human eye, wherein the ratio as measured in lux is on the order of 20:1 or 10:1 for lower light or nighttime conditions and on the order of 6:1 or 5:1 for very low light conditions approaching lowest level of eye sensitivity.

38. The method of claim 37 wherein the ratio is in the approximate range of 100:1 to 1:1.

39. The method of claim 38 wherein the ratio is on the order of 5:1 or 6:1.

40. The method of claim 37 wherein the color temperature differs between the primary light and the secondary light.

41. The method of claim 40 wherein the color temperature of the primary light is on the order of 3000K and the color temperature of the secondary light is on the order of 4000K.

42. A method for lighting in an area adapted for viewing or traversing by people comprising:

a. providing a non-point light source at or near the area;

b. providing task lighting generally at or near the non-point light source;

c. producing with the non-point light source and task lighting a scene brightness ratio that is less than the typical scene adaptive range of a human eye;

d. wherein the non-point is directly viewable from most viewing angles but a source of the task lighting is not.

43. The method of claim 42 wherein for a given scene adaptive range of the human eye, the scene brightness ratio is less than or equal to 10:1.

44. The method of claim 42 wherein the non-point light and task lighting comprise different color temperatures.

45. The method of claim 42 wherein the non-point light is directly viewable by people, the task lighting produces luminance at the target area which is a luminance level to which a typical human eye adapts, and luminance from the directly viewable non-point light is at or below the luminance from the task lighting so that the eye receives maximum utilization of the task lighting of the targeted area.

46. The method of claim 45 further comprising the task lighting is produced by a light source and the light source of the task lighting is not in the normal field of vision of people.

47. The method of claim 42 wherein the non-point light functions its a visible reference or guide in daylight or at nighttime.

48. The method of claim 42 wherein the non-point light comprises a light source that is directly viewable from most viewing angles or comprises a wall or surface spaced from a light source.

49. The method of claim 42 further comprising utilizing one or more of the following parameters in providing the non-point light and task lighting: light source lumens, desired level of luminance, ambient and background light levels, type and reflectivity of target area, desired target brightness relative to ambient light, mounting height or heights, and optical configurations.

* * * * *

UNITED STATES PATENT AND TRADEMARK OFFICE

CERTIFICATE OF CORRECTION

PATENT NO. : 8,256,921 B2
APPLICATION NO. : 12/466640
DATED : September 4, 2012
INVENTOR(S) : Joe P. Crookham et al.

It is certified that error appears in the above-identified patent and that said Letters Patent is hereby corrected as shown below:

Column 23, Claim 17, Line 32:
DELETE after claim "1"
ADD after claim --15--

Column 24, Claim 27, Line 28:
DELETE after comprises ","

Column 25, Claim 33, Line 9:
ADD after the area --;--

Column 25, Claim 35, Line 30:
DELETE after luminance ":"
ADD after luminance --;--

Column 26, Claim 47, Line 39:
DELETE after functions "its"
ADD after functions --as--

Signed and Sealed this
Sixth Day of November, 2012

David J. Kappos

David J. Kappos
*Director of the United States Patent and Trademark Office*

UNITED STATES PATENT AND TRADEMARK OFFICE

CERTIFICATE OF CORRECTION

PATENT NO. : 8,256,921 B2
APPLICATION NO. : 12/466640
DATED : September 4, 2012
INVENTOR(S) : Crookham et al.

It is certified that error appears in the above-identified patent and that said Letters Patent is hereby corrected as shown below:

In the Drawings

Sheet 7 of 20, FIG. 2A:
Delete drawing sheet 7 of 20 and replace with Replacement Sheet 1 of 2

Sheet 11 of 20, FIG. 2E, 2F:
Delete drawing sheet 11 of 20 and replace with Replacement Sheet 2 of 2

In the Specification

Col. 1, Line 41:
DELETE after and "2B"
ADD after and --1B--

Col. 13, Line 37:
DELETE after given "the (B=0.03, F=0.25)"
ADD after given --that B=0.03, F=0.25--

Col. 16, Line 22:
DELETE after base "11/14"
ADD after base --11 or collar 34--

Col. 16, Line 35:
DELETE before could "14"
ADD before could --34--

Col. 16, Line 40:
DELETE after collar "14"
ADD after collar --34--

Signed and Sealed this
Twenty-fourth Day of March, 2015

Michelle K. Lee

Michelle K. Lee
*Director of the United States Patent and Trademark Office*

Col. 16, Line 52:
DELETE after collar "14"
ADD after collar --34--

Col. 16, Line 57:
DELETE after collar "14"
ADD after collar --34--